US009162451B2

(12) United States Patent
Yorimoto et al.

(10) Patent No.: US 9,162,451 B2
(45) Date of Patent: Oct. 20, 2015

(54) IMAGE FORMING APPARATUS, PROGRAM, AND IMAGE FORMING SYSTEM

(71) Applicants: Mamoru Yorimoto, Kanagawa (JP); Tatsuhiko Okada, Kanagawa (JP); Daisaku Horikawa, Kanagawa (JP); Makoto Moriwaki, Kanagawa (JP)

(72) Inventors: Mamoru Yorimoto, Kanagawa (JP); Tatsuhiko Okada, Kanagawa (JP); Daisaku Horikawa, Kanagawa (JP); Makoto Moriwaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/091,453

(22) Filed: Nov. 27, 2013

(65) Prior Publication Data

US 2014/0152735 A1 Jun. 5, 2014

(30) Foreign Application Priority Data

Dec. 5, 2012 (JP) ..... 2012-266314

(51) Int. Cl.

| | |
|---|---|
| ***B41J 29/393*** | (2006.01) |
| ***B41J 2/125*** | (2006.01) |
| ***B41J 29/38*** | (2006.01) |
| ***B41J 11/00*** | (2006.01) |

(52) U.S. Cl.

CPC ..... *B41J 2/125* (2013.01); *B41J 11/0095* (2013.01); *B41J 29/38* (2013.01)

(58) Field of Classification Search

CPC ..... B41J 29/393; B41J 2/0458–2/04588; B41J 2/125; B41J 2/14153; B41J 11/008; B41J 11/009–11/0095; B41J 11/42; B41J 11/485; B41J 13/009; B41J 13/26–13/32; G01N 21/00; G01N 21/86

USPC ..... 347/19

See application file for complete search history.

(56) References Cited

U.S. PATENT DOCUMENTS

| | | | | |
|---|---|---|---|---|
| 6,033,137 | A * | 3/2000 | Ito | 400/74 |
| 7,798,634 | B2 | 9/2010 | Miyahara et al. | |
| 7,841,682 | B2 | 11/2010 | Yorimoto et al. | |
| 7,854,489 | B2 | 12/2010 | Hagiwara et al. | |
| 7,914,096 | B2 | 3/2011 | Hagiwara et al. | |
| 7,992,953 | B2 | 8/2011 | Yorimoto et al. | |
| 8,042,904 | B2 | 10/2011 | Niihara et al. | |
| 8,066,348 | B2 | 11/2011 | Hirota et al. | |
| 8,132,883 | B2 | 3/2012 | Niihara et al. | |
| 8,157,342 | B2 | 4/2012 | Morino et al. | |
| 8,186,799 | B2 | 5/2012 | Morino et al. | |
| 8,308,272 | B2 | 11/2012 | Naruse et al. | |

(Continued)

FOREIGN PATENT DOCUMENTS

| | | |
|---|---|---|
| JP | 2007-091467 | 4/2007 |
| JP | 2007-245428 | 9/2007 |

(Continued)

*Primary Examiner* — Jannelle M Lebron
*Assistant Examiner* — Jeremy Bishop
(74) *Attorney, Agent, or Firm* — Harness, Dickey & Pierce

(57) ABSTRACT

An image forming apparatus which reads a test pattern formed by ejecting liquid droplets onto a recording medium to adjust an ejection timing of the liquid droplets is disclosed. The image forming apparatus includes a reading unit including a light emitting unit and a light receiving unit; a sensitivity adjusting unit; a relative movement unit; a first correction unit which detects a position of the test pattern; a second correction unit which detects the position of the test pattern; and a correction method selecting unit which selects the first correction unit or the second correction unit based on adjusting results of sensitivity adjusted by the sensitivity adjusting unit.

8 Claims, 32 Drawing Sheets

(56) References Cited

U.S. PATENT DOCUMENTS

| | | | |
|---|---|---|---|
| 8,414,105 | B2 | 4/2013 | Komuro et al. |
| 8,424,997 | B2 | 4/2013 | Kobayashi et al. |
| 8,425,006 | B2 | 4/2013 | Mase et al. |
| 8,491,080 | B2 | 7/2013 | Sakurada et al. |
| 8,496,312 | B2 | 7/2013 | Sakurada et al. |
| 8,529,012 | B2 | 9/2013 | Yorimoto et al. |
| 8,534,789 | B2 | 9/2013 | Sakurada et al. |
| 8,556,379 | B2 | 10/2013 | Naruse et al. |
| 8,573,726 | B2 | 11/2013 | Mase et al. |
| 8,581,944 | B2 | 11/2013 | Okada et al. |
| 2008/0231649 | A1 | 9/2008 | Kawabata et al. |
| 2009/0189937 | A1 | 7/2009 | Naruse et al. |
| 2012/0218336 | A1 | 8/2012 | Okada et al. |
| 2012/0218340 | A1 | 8/2012 | Horikawa et al. |
| 2012/0218568 | A1 | 8/2012 | Yorimoto et al. |
| 2012/0229546 | A1 | 9/2012 | Okada et al. |
| 2013/0027457 | A1 | 1/2013 | Yamazaki et al. |

FOREIGN PATENT DOCUMENTS

| | | |
|---|---|---|
| JP | 2008-229915 | 10/2008 |
| JP | 2012-187914 | 10/2012 |

* cited by examiner

FIG.29

| LIGHT RECEIVING ELEMENT | MULTIPLYING FACTOR INCREASE OPERATION | SIGNAL CORRECTION | PAPER TYPE |
|---|---|---|---|
| DIFFUSE REFLECTION | NO | NO | PLAIN PAPER, RECYCLED PAPER, GLOSSY PAPER |
| DIFFUSE REFLECTION | YES | YES | TRACING PAPER, MAT FILM |
| REGULAR REFLECTION | — | NO AUTOMATIC POSITION OFFSET ADJUSTMENT | OHP SHEET, PARTIALLY FILM |

IMAGE FORMING APPARATUS, PROGRAM, AND IMAGE FORMING SYSTEM

TECHNICAL FIELD

The present invention generally relates to liquid-ejecting image forming apparatuses and more specifically relates to an image forming apparatus which can correct an offset of an impacting position of liquid droplets.

BACKGROUND ART

Image forming apparatuses (below called liquid-ejecting image forming apparatuses) are known which eject liquid droplets onto a sheet material such as a sheet of paper to form an image and produce printed matter. The liquid ejecting image forming apparatuses may generally be divided into a serial-type image forming apparatus and a line-head type image forming apparatus. In the serial-type image forming apparatus, a recording head thereof moves in both main scanning directions perpendicular to a direction of sheet conveying while the sheet conveying is repeated to form an image over the sheet of paper to produce printed matter. In the line head-type image forming apparatus with nozzles being aligned in a length which is almost the same length as a maximum width of the sheet of paper, when timing arrives at which the sheet of paper is conveyed and the liquid droplets are ejected, nozzles within the line head eject the liquid droplets to form the image.

However, it is known that, in the serial-type image forming apparatus, when one ruled line is printed in both directions of an outward path and a return path, an offset of the ruled line is likely to occur between the outward path and the return path. Moreover, it is known that, in the line head-type image forming apparatus, parallel lines are likely to appear in the sheet-conveying direction when there is a nozzle whose position of impacting is constantly offset due to a mounting error, finishing accuracy of the nozzle, etc.

Therefore, in the liquid-ejecting image forming apparatus, it is often the case that a test pattern for self-adjustment to adjust the position of impacting the liquid droplets is printed on the sheet material, the test pattern is optically read, and an ejection timing is adjusted based on the read results (see Patent Document 1, for example.)

Patent Document 1 discloses an image forming apparatus which includes a pattern forming unit that forms, on a water-repellent member having water-repellent properties, a reference pattern including multiple independent liquid droplets and a pattern to be measured that includes multiple independent liquid droplets ejected under an ejection condition different from the reference pattern such that they are arranged in a scanning direction of a recording head; a reading unit including a light emitting unit which irradiates a light onto the respective patterns and a light receiving unit which receives a regular reflected light from the respective patterns; and a correction unit which measures a distance between the respective patterns based on read results of the reading unit for correcting of a liquid droplet ejection timing of the recording head based on the measurement results.

FIG. 1A is an example of a diagram which schematically describes a light receiving element which reads test patterns. When a spotlight which is irradiated by an LED scans the test pattern in an arrowed direction, a reflected light in accordance with a density of a scanning position of the spotlight is detected at the light receiving element. As is well known, light is absorbed well by a black object, so that it is difficult for the spotlight to be absorbed when the test pattern is scanned if a sheet material is white and the test pattern is black. If the reflected light received by the light receiving element is shown in voltage, as shown, a voltage when the spotlight is superposed on the test pattern is substantially lower than a voltage when what is other than the test pattern is scanned.

FIG. 1B is an example of a diagram showing voltage changes in an enlarged manner. The horizontal axis is time, or a scanning position of the spotlight. An elongated circle shows regions in which the voltage is sharply changing. It is inferred that an edge of the test pattern is within the region, so it is determined, for example, that a center of gravity of the spotlight scans the edge of the test pattern when the voltage value shows a center value of a local maximum and a local minimum. Therefore, when the voltage value shows the median of voltage amplitudes, for example, the image forming apparatus may determine that there is the edge position of the test pattern at the scanning position and specify a position of the test pattern.

However, there is a problem that, when a sheet material is a material with a low reflectance (or a high transmittance) such as a tracing paper, it is difficult for an output voltage of the light receiving element to be stable, so that the edge position of the test pattern may not be specified accurately. In other words, for the sheet material with the low reflectance, a decrease in the amplitude of the voltage value, a variation in the transmittance of the sheet material, or an amplification of sensor sensitivity or transmittance fluctuations of the sheet material causes the voltage value to be unstable. When the amplitude of the output voltage of the light receiving element decreases or becomes unstable, specific accuracy of the edge position of the test pattern decreases, so that accuracy of adjusting liquid droplet ejection timing decreases.

While changing a process of correcting an ejection timing in accordance with a type of sheet of paper may be considered, as the type of sheet of paper is set by a user operation, a case may occur that an adjustment operation suitable for the type of sheet is not possible, leading to a problem that desired adjustment accuracy is not obtained. Moreover, a problem may occur that down time of the image forming apparatus increases when a correction process is performed regardless of the type of paper.

PATENT DOCUMENT

Patent Document 1: JP2008-229915A

DISCLOSURE OF THE INVENTION

In light of the problems as described above, an object of embodiments of the present invention is to provide an image forming apparatus which can suppress an impact of properties of a sheet material and an increase in down time to accurately specify a position of a test pattern.

According to an embodiment of the present invention, an image forming apparatus which reads a test pattern formed by ejecting liquid droplets onto a recording medium to adjust an ejection timing of the liquid droplets is provided, including a reading unit including a light emitting unit which irradiates a light onto the recording medium and a light receiving unit which receives a reflected light from the recording medium; a sensitivity adjusting unit which adjusts a sensitivity of the light receiving unit such that an output of the light receiving unit falls within a predetermined range before the test pattern is formed; a relative movement unit which relatively moves the recording medium or the reading unit at an equal speed; a first correction unit which detects a position of the test pattern by applying a position determining process on detection data of the reflected light received from a scanning position of the light by the light receiving unit while the reading unit moves relative to the recording medium after the test pattern is formed; a second correction unit which detects the position of the test pattern by applying the position determining process on the test pattern after an amplitude of an interval period of the test pattern is aligned to be generally constant, the amplitude appearing in the detection data of the reflected light received from the scanning position of the light by the light receiving unit while the reading unit moves relative to the recording medium after the test pattern is formed; and a correction method selecting unit which selects the first correction unit or the second correction unit based on the adjusting results of the sensitivity adjusted by the sensitivity adjusting unit.

Embodiments of the present invention make it possible to suppress an impact of properties of a sheet material and an increase in down time to accurately specify a position of a test pattern.

BRIEF DESCRIPTION OF THE DRAWINGS

Other objects, features, and advantages of the present invention will become more apparent from the following detailed descriptions when read in conjunction with the accompanying drawings, in which:

FIG. 29 is one example of a diagram showing a relationship of processing results of calibration, paper type, and presence/absence of a signal correction process;

BEST MODE FOR CARRYING OUT THE INVENTION

A description is given below with regard to embodiments of the present invention with reference to the drawings.

Embodiment 1

According to the present embodiment, two processes (a pattern-independent portion removal process and an amplitude correction process) are used to specify a position of a test pattern. The two processes are collectively called a signal correction process.

Pattern-Independent Portion Removal Process

First, factors contributing to an output voltage of a light receiving element are described. Many of lights received by the light receiving element are reflected lights of lights emitted to a sheet material by a light emitting element, which reflected lights include those reflected from the sheet material and those reflected from a sheet-shaped member (below-called platen) under the sheet. Moreover, lights such as background radiation and aerial scattered lights as well as the reflected lights are also received by the light receiving element. These are defined as per below:

Vsg: output voltage of all lights received by the light receiving element;

Vp: output voltage due to a dark output, aerial scattered lights, reflected lights due to the fact that not all of lights are absorbed even at a portion on which a test pattern is formed; and Vs: output voltage to be detected Now, an object of the present embodiment is to detect a position of a test pattern from lights reflected from the portion on which the test pattern is formed and lights reflected from a portion on which the test pattern is not formed. Thus, a part of the reflected lights that does not vary due to forming the test pattern may be removed to extract a signal which varies in accordance with a test pattern to be targeted. The output voltage Vp which includes the dark output and lights not absorbed even at the portion on which the test pattern is formed is a voltage which is output regardless of whether the test pattern is formed, so that the output voltage Vp is considered to be an output voltage which does not vary due to forming of the test pattern. The "reflected light due to lights not absorbed even at the portion on which the test pattern is formed" includes what is reflected by the sheet that was not absorbed by the test pattern and what penetrates through the sheet to be reflected by the platen, which are not referred to herein. Moreover, in practice, changes occur due to various varying factors as described below.

Below, an example is described in which a signal to be targeted is extracted when the test pattern is monochrome. While explanations for Vsg, Vp, and Vs are the same as for those described above, letters 1, 2, etc., are assigned for purposes of explanations.

Figure 1A:
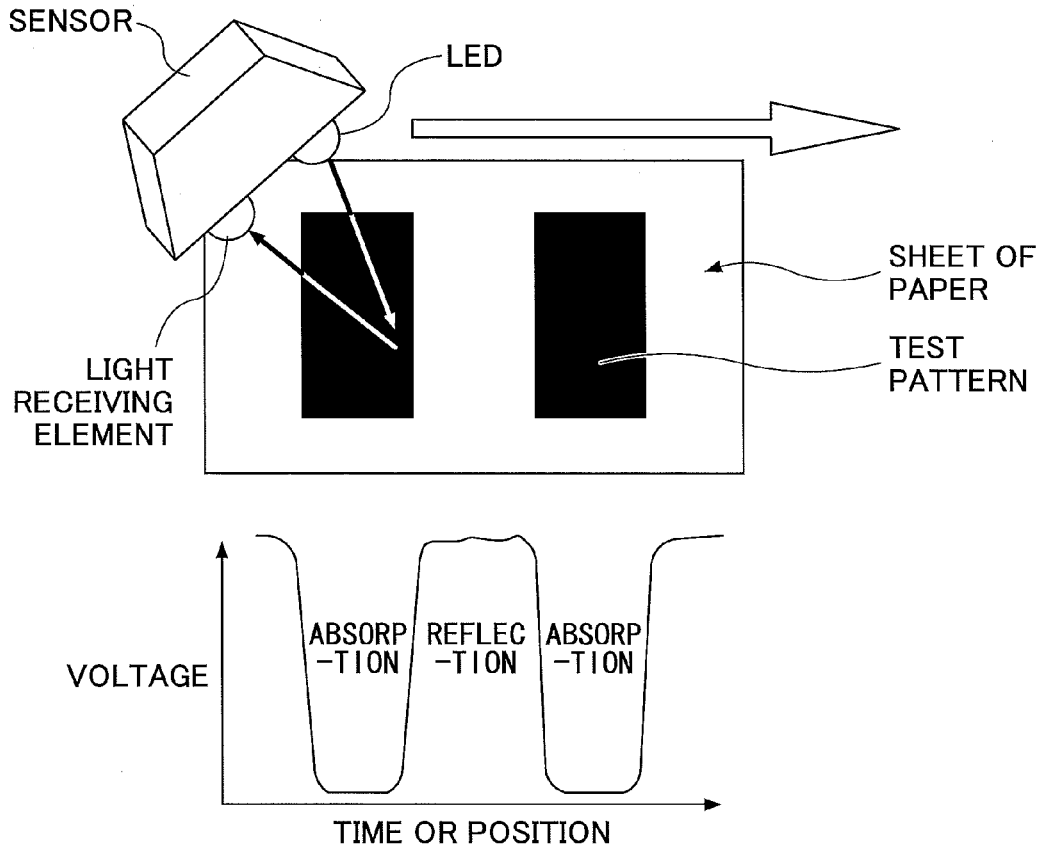
FIGS. 1A and 1B show an example of a diagram which schematically describes a light receiving element which reads a test pattern.
Figure 1B:
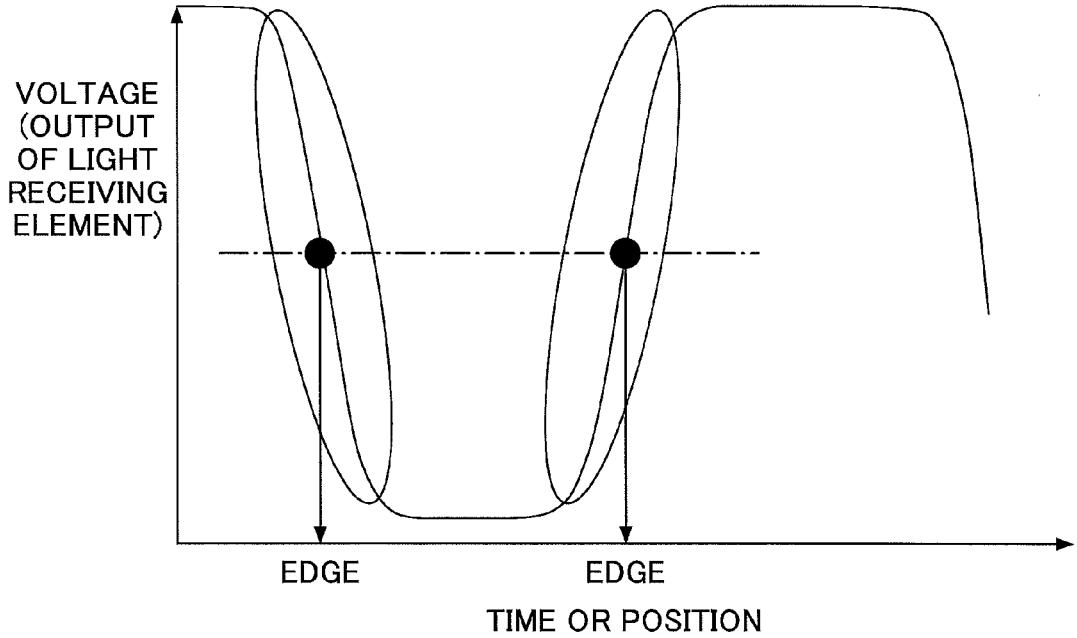
Figure 2:
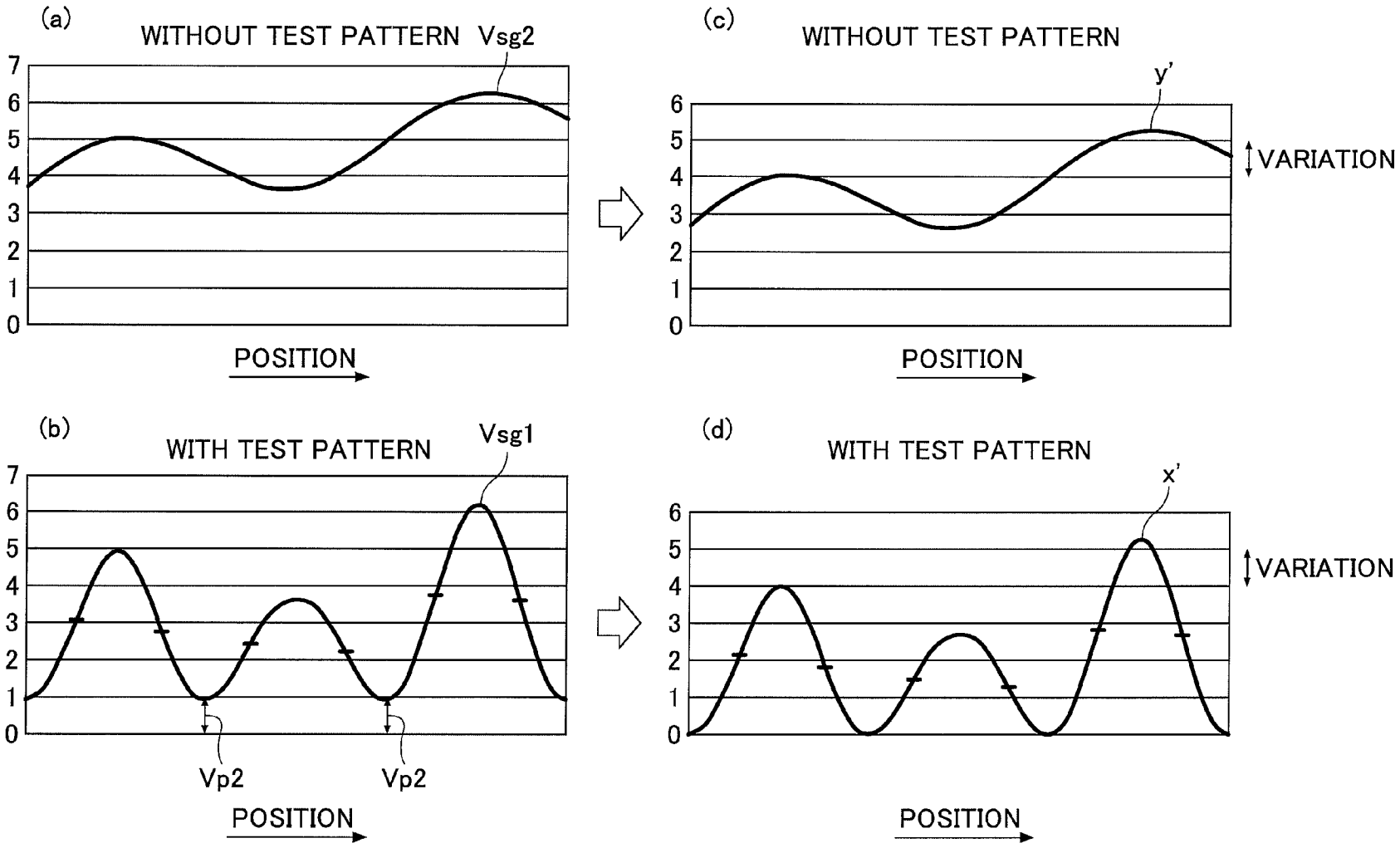
FIG. 2 is an exemplary drawing for explaining a pattern-independent portion removal process.

First, Vsg1 of (b) in FIG. 2 is a waveform of an output voltage when a test pattern is formed. At Vsg1, at the portion on which the test pattern is formed, the test pattern absorbs lights, so that the reflected lights decrease. In this way, amplitude with a period of a test pattern interval is output. However, Vp in (b) in FIG. 2 is output even at the portion on which the test pattern is formed. This is the output voltage Vp which does not vary due to the forming of the test pattern.

In other words, Vp may be subtracted from Vsg1 to extract Vs2 (below-called x') of (d) in FIG. 2 that is a signal which varies with forming of the test pattern.

Next, a process of a signal variation due to a sheet reflectance variation is described using (a) and (c) in FIG. 2. FIG. 2 (in (a)) shows an output voltage Vsg1 for a case without a test pattern. Moreover, FIG. 2 (in (c)) shows Vs1 (below-described y'), which is the output voltage Vsg1 for the case without the test pattern, with Vp subtracted. Here, as shown by y' in FIG. 2 (in (c)), the output voltage varies even when there is no absorption by the test pattern. The above variation largely depends on the sheet reflectance, which variation is also included in the output voltage x' in FIG. 2 (in (d)). Amplitude of x' also varies, which shows what is described in the above. Such a variation causes accuracy of detecting a position of the test pattern to decrease.

As described below, an image forming apparatus uses output voltage data sets around points of inflection (short horizontal lines shown on the output voltage) to determine an edge position of a line which makes up the test pattern. However, as a position of the points of inflection is not stable, accuracy of detecting the edge position of the test pattern decreases. Thus, the image forming apparatus of the present embodiment performs an amplitude correction process which suppresses a variation of x' in FIG. 2 (in (d)).

Amplitude Correction Process

Figure 3A:
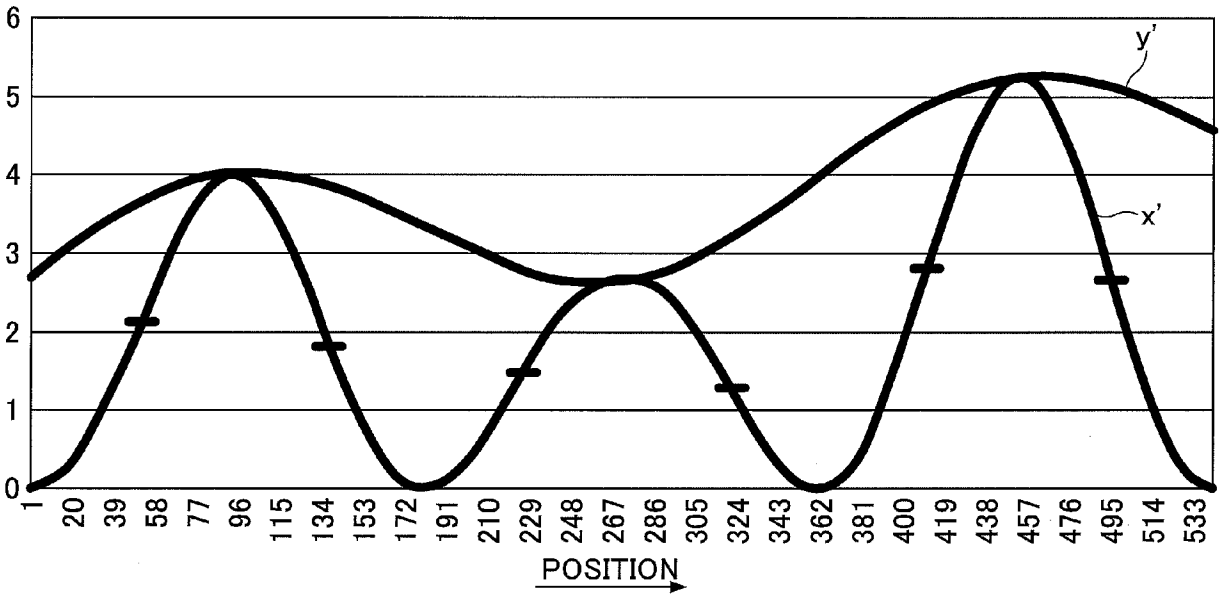
FIGS. 3A and 3B are exemplary drawings for explaining an amplitude correction process.

FIG. 3A shows one example of a graphic representation in which x' (Vs1) and y' (Vs2) overlap. x' and y' become output voltage data for the same scanning position as a result of the below-described synchronization process, so that, x' and y' become equal when a spotlight scans a position without the test pattern while x' becomes generally zero when it scans a position with the test position. As a result of the above-described pattern-independent portion removal process, an output voltage due to reflected lights that occurs even at the position with the test pattern is removed. In other words, this represents that x' is an output voltage which is output due to reflected lights other than lights absorbed by the test pattern with y' as a reference (a maximum) at a certain position. In other words, even when a variation caused by a transmittance of the sheet material, etc., differs from position to position, at a position at which the variation increases the output voltage (a position at which y' is large) x' also increases, whereas at a position at which the variation decreases the output voltage (a position at which y' is small) x' also decreases. Then, at a portion on which the pattern is formed, it becomes generally zero.

In other words, this shows that a variation caused by a position included in x' can be properly corrected with a proportional correction called "x'/y'".

Therefore, an appropriate fixed value may be determined as amplitude to obtain output voltage data with constant amplitude with "a fixed value x (x'/y')". Based on the above, when the output voltage is assumed to be z, the output voltage z after the amplitude correction process may be shown as z=fixed value x (x'/y').

Figure 3B:
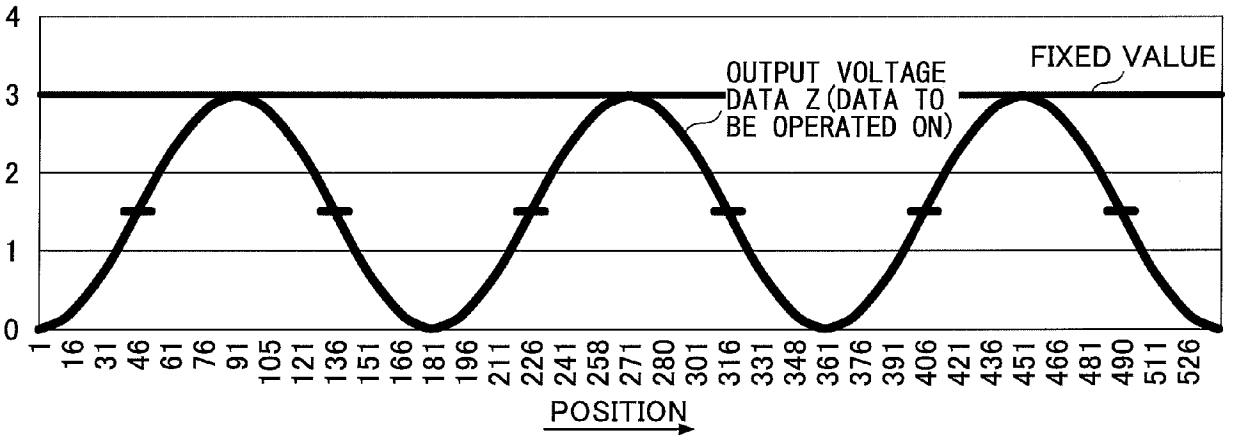

FIG. 3B shows one example of the output voltage z. The output voltage z with a stable amplitude with a period of an interval of the test pattern (below-described data to be operated on) is obtained with a fixed value reflecting a ratio between x' and y'.

The above-described two-stage signal correction process makes it possible to accurately specify an edge position of a test pattern even when amplitude of output voltage data becomes unstable due to characteristics of the sheet material.

Then, the image forming apparatus according to the present embodiment switches between performing the signal correction process and not performing the signal correction process in accordance with a reflectance of the sheet material (in the present embodiment, while this may be set as a reflectance for a spotlight for determining a position of a line center, it is a reflectance for a visible light or a light of a general wavelength without limiting a wavelength in particular. More specifically, for a sheet material with a low reflectance, such as tracing paper, etc., the pattern independent portion removal process and the amplitude correction process are performed. On the other hand, with the sheet material such as plain paper or glossy paper, the pattern-independent portion removal process and the amplitude correction process are not performed. This makes it possible to appropriately adjust ejection timing for a sheet material with low reflectance such as the tracing paper, etc., and to adjust ejection timing without increasing down time in the sheet material such as the plain paper or the glossy paper. As described below, the reflectance of the sheet material (paper type) is not set by a user, but determined by calibration results of the light receiving element, so that it is unlikely that an adjustment operation suitable for the paper type is not possible.

(Configuration)

Figure 4:
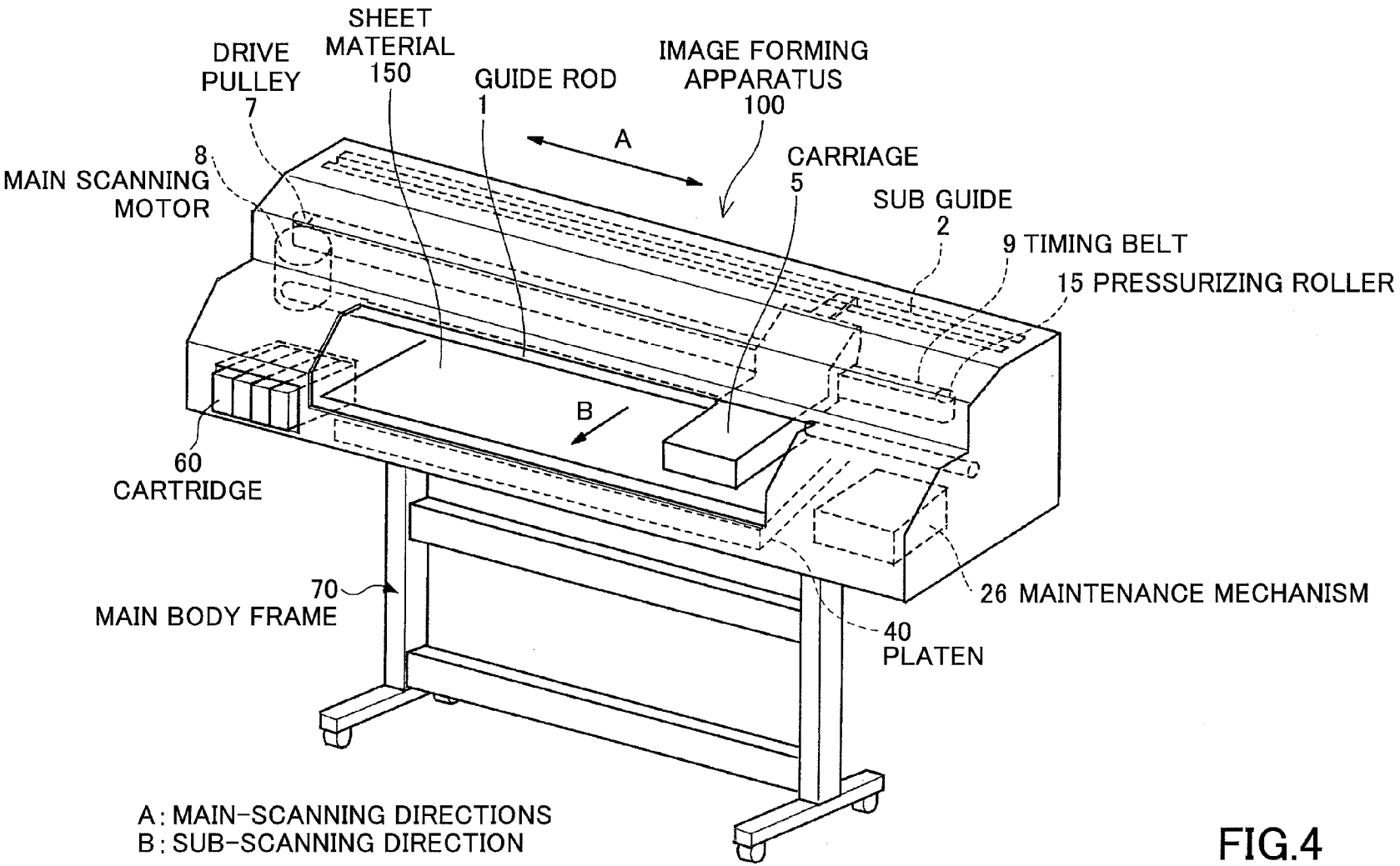
FIG. 4 is an example of a schematic perspective view of a serial-type image forming apparatus.

FIG. 4 illustrates an exemplary schematic perspective view of a serial image forming apparatus 100. The image forming apparatus 100 is supported by a main body frame 70. A guide rod 1 and a sub guide 2 are bridged across in a longitudinal direction of the image forming apparatus 100, and a carriage 5 is held in arrow A directions (main scanning directions) by the guide rod 1 and the sub guide 2 such that it can move in both directions.

Moreover, an endless belt-shaped timing belt 9 is stretched by a drive pulley 7 and a pressurizing roller 15 in the main scanning directions, and a part of the timing belt 9 is fixed to the carriage 5. Moreover, the drive pulley 7 is rotationally driven by a main scanning motor 8, thereby moving the timing belt 9 in the main scanning directions and also moving the carriage 5 in both directions in association therewith. With the tension being applied to the timing belt 9 by the pressurizing roller 15, the timing belt 9 may drive the carriage 5 without slack.

Moreover, the image forming apparatus 100 includes a cartridge 60 which supplies ink and a maintenance mechanism 26 which maintains and cleans a recording head.

A sheet material 150 is intermittently conveyed on a platen 40 on the lower side of the carriage 5 in an arrow B direction (a sub-scanning direction) by a roller (not shown). The sheet material 150 may be a recording medium on which liquid droplets can be placed, such as an electronic substrate, a film, a glossy paper, a plain paper such as a sheet of paper, etc. For each conveying position of the sheet material 150, the carriage 5 moves in the main scanning directions and the recording head mounted on the carriage 5 ejects the liquid droplets. When the ejecting is finished, the sheet material 150 is again conveyed and the carriage 5 moves in the main scanning directions to eject the liquid droplets. The above process is repeated to form an image on a whole face of the sheet material 150, producing printed matter.

Figure 5:
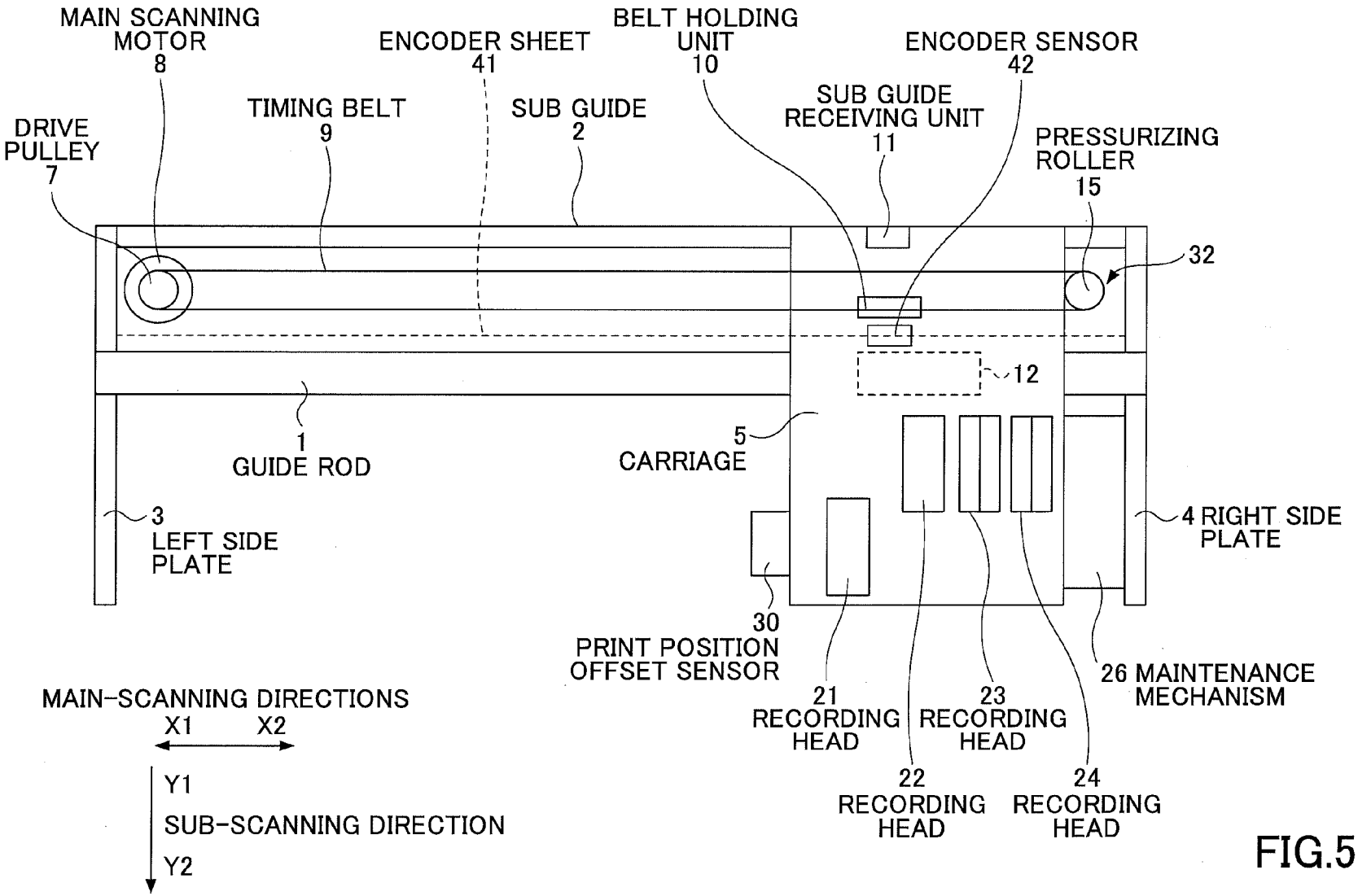
FIG. 5 is an exemplary drawing for explaining in more detail an operation of a carriage.

FIG. 5 is an exemplary drawing which describes in more detail operations of the carriage 5. The above-described guide rod 1 and the sub rod 2 are bridged across a left side plate 3 and a right side plate 4, and the carriage 5 is held by bearings 12 and a sub-guide receiving unit 11 to be able to freely slide on the guide rod 1 and the sub-guide 2, so that it can move in arrows X1 and X2 directions (main scanning directions).

On the carriage 5 are mounted recording heads 21 and 22 which eject black (K) liquid droplets, and recording heads 23 and 24 which eject ink droplets of cyan (C), magenta (M), and yellow (Y). The recording head 21 is arranged since the black is often used, so that it may be omitted.

As the recording heads 21-24, there may be a so-called piezo-type recording head in which piezoelectric elements are used as pressure generating units (an actuator unit), each of which pressurizes ink within an ink flow path (a pressure generating chamber) by deforming a vibrating plate which forms a wall face of the ink flow path to change a volume within the ink flow path to cause an ink droplet to be ejected; a so-called thermal-type recording head in which ink droplets are ejected with pressure due to using a heat generating resistive body to heat ink within each of the ink channel paths to generate a foam; or an electrostatic-type recording head in which sets of a vibrating plate and an electrode, which form a wall face of the ink flow path, are arranged so that they oppose each other, and the vibrating plate is deformed due to an electrostatic force generated between the vibrating plate and the electrode, etc., to change a volume within the ink flow path to cause an ink droplet to be ejected.

A main scanning mechanism 32 which moves the carriage 5 to scan includes the main scanning motor 8 which is arranged on one side in the main scanning directions, the drive pulley 7 which is rotationally driven by the main scanning motor 8, the pressurizing roller 15 which is arranged on the other side in the main scanning directions, and the timing belt 9 which is bridged across the drive pulley 7 and the pressurizing roller 15. The pressurizing roller 15 has tension acting outward (in a direction away from the drive pulley 7) applied by a tension spring (not shown).

The timing belt 9 has a portion fixed to and held by a belt holding unit 10 which is provided on a back face side of the carriage 5, so that it pulls the carriage 5 in the main scanning directions with an endless movement of the timing belt 9.

Moreover, with an encoder sheet 41 arranged such that it follows the main scanning directions of the carriage 5, an encoder sensor 42 the carriage 5 is provided with may read slits of the encoder sheet 41 to detect a position of the carriage 5 in the main scanning directions. When the carriage 5 exists in a recording area out of a main scanning area, the sheet material 150 is intermittently conveyed in an arrow-indicated Y1 to Y2 direction (a sub-scanning direction) which is orthogonal to the main scanning directions of the carriage 5 by a paper-conveying mechanism (not shown).

The above-described image forming apparatus 100 according to the present embodiment may drive the recording heads 21-24 according to image information to eject liquid droplets while moving the carriage 5 in the main scanning directions and intermittently convey the sheet material 150 to form a required image on the sheet material 150, producing printed matter.

On one side face of the carriage 5 is mounted a print position offset sensor 30 for detecting an offset of an impacting position (reading the test pattern). The print position offset sensor 30 reads a test pattern for detecting the impacting position that is formed on the sheet material 150 with a light receiving element which includes a reflective-type photo sensor and a light-emitting element such as an LED, etc.

As the print position offset sensor 30 is for the recording head 21, a liquid droplet ejection timing of the recording heads 22-24 is adjusted, so it is preferable to mount a separate print position offset sensor 30 parallel to the recording heads 22-24. Moreover, the carriage 5 may have mounted a mechanism which slides the print position offset sensor 30 such that it becomes in parallel with the recording heads 22-24 to adjust a liquid droplet ejection timing of the recording heads 22-24 with one print position offset sensor 30. Alternatively, the liquid droplet ejection timing of the recording heads 22-24 may be adjusted with the one print position offset sensor 30 even when the image forming apparatus 100 conveys the sheet material 150 in a reverse direction.

Figure 6:
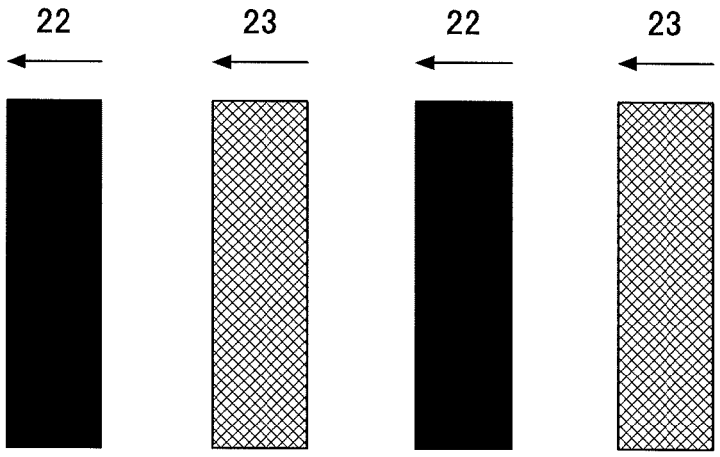
FIG. 6 is a diagram illustrating an example of the test pattern formed in mono-directional print.
Figure 7:
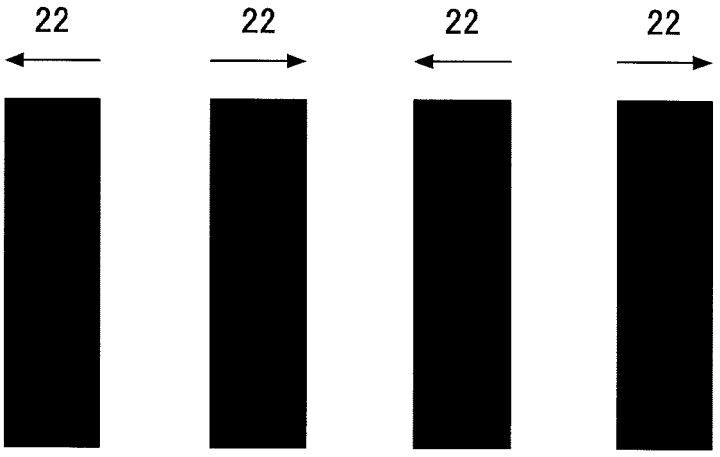
FIG. 7 is a diagram illustrating an example of the test pattern formed in bi-directional print.

FIGS. 6 and 7 are diagrams showing one example of the test pattern with FIG. 6 showing the test pattern formed in a mono-directional print and FIG. 7 showing the test pattern formed in a bi-directional print. Numbers on the upper side of each line are letters for the recording heads 21-24, while arrows on the upper side of each line show an outward path (an X1 direction in FIG. 5) or a return path (an X2 direction in FIG. 5).

In FIG. 6, a line for black ejected by the recording head 22 and a line for magenta (or cyan) ejected by the recording head 23 are alternately formed. The recording heads 22 and 23 eject ink only in the outward path.

In FIG. 7, all the lines are lines for black ejected by the recording head 22. In the test pattern in FIG. 7, a line formed only in the forward path and a line formed only in the return path are alternately arranged. For example, a line formed in the return path is used for adjusting liquid droplet ejection timing.

In the image forming apparatus 100 according to the present embodiment, a liquid droplet ejection timing of the recording heads 21-24 is adjusted based on an output of the print position offset sensor 30, after which the recording heads 21-24 are driven according to image information at the adjusted timing while moving the carriage 5 in the main scanning directions and intermittently conveying the sheet material 150. In response to the above-described driving, liquid droplets are ejected to thereby form an image without an offset on the sheet material 150, producing printed matter. The sheet material 150 on which the image is formed is one example of a printing medium. In the present embodiment, although the same number is given for the sheet material 150 on which the test pattern is formed and the sheet material 150 on which the image is formed, these sheet materials may be the same or different. For example, when a roll paper is used as a sheet material, the two sheet materials are the same sheet material until they are cut in a subsequent process. Moreover, when a cut paper is used as a sheet material, the two sheet materials are considered to be different sheet materials.

Figure 8:
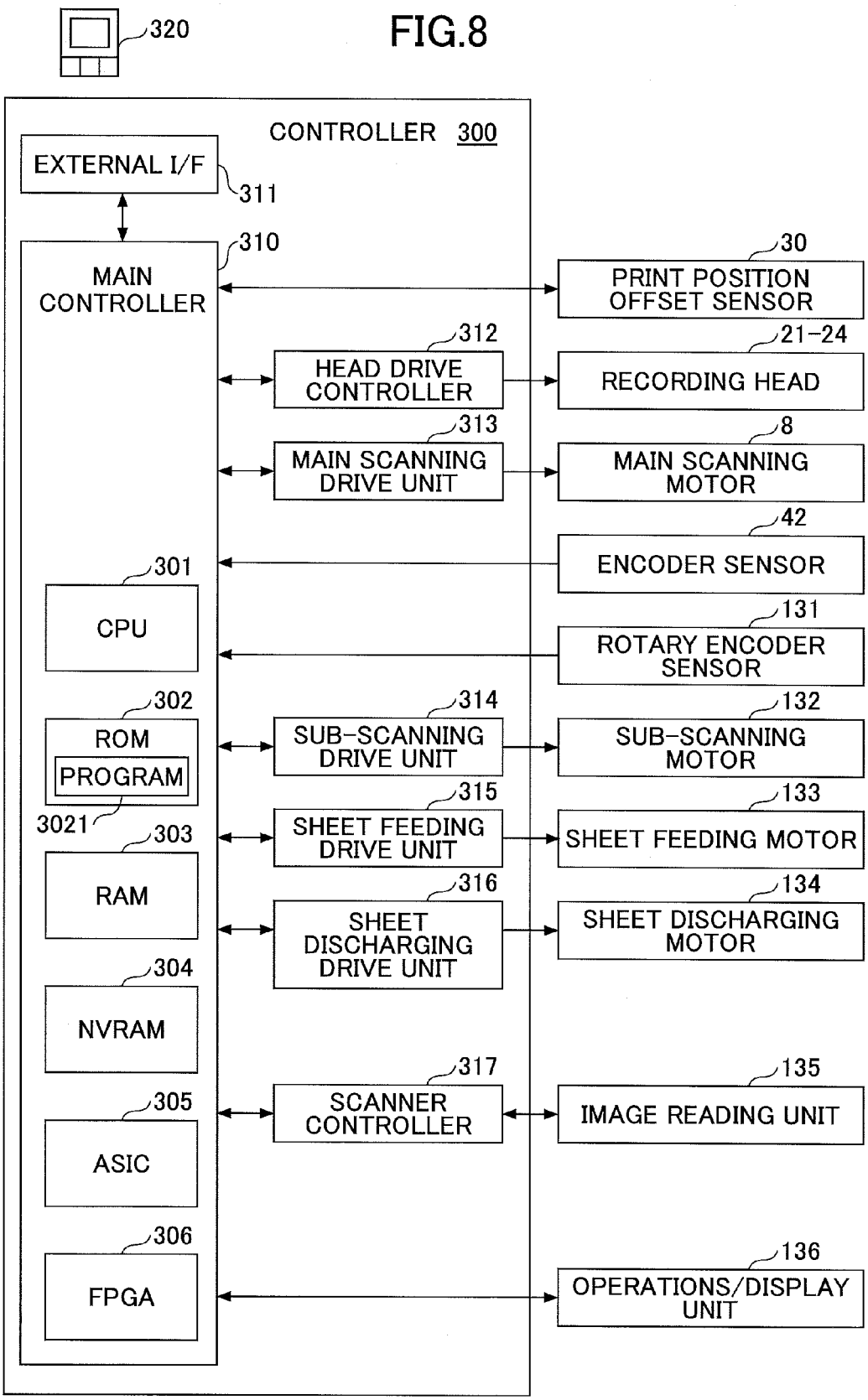
FIG. 8 is an exemplary block diagram of a controller of an image forming apparatus.

FIG. 8 is an exemplary block diagram of a controller 300 of the image forming apparatus 100. The controller 300 includes a main controller 310 and an external I/F 311. The main controller 310 includes a CPU 301, a ROM 302, a RAM 303, an NVRAM 304, an ASIC 305, and an FPGA (Field programmable gate array) 306. The CPU 301 executes a program 3021 which is stored in the ROM 302 to control the entirety of the image forming apparatus 100. In the ROM 302 is stored, besides the program 3021, fixed data such as a parameter for control, an initial value, etc. The RAM 303 is a working memory which temporarily stores a program, image data, etc., while the NVRAM 304 is a non-volatile memory for storing data such as a setting condition, etc., even during a time a power supply of an apparatus is being blocked. The ASIC 305 performs various signal processing, sorting, etc., on the image data and controls various engines. The FPGA 306 processes input and output signals for controlling the whole apparatus.

The main controller 310 manages control with respect to forming a test pattern, detecting the test pattern, adjusting (correcting) an impacting position, etc., as well as control of the whole apparatus. As described below, in the present embodiment, while mainly the CPU 301 executes the program 3021 stored in the ROM 302 to detect an edge position, some or all thereof may be performed by an LSI, such as the FPGA 306, the ASIC 305, etc.

The external I/F 311 is a bus or a bridge for connecting to IEEE 1394, a USB, and a communications apparatus for communicating to other equipment units connected to the network. Moreover, the external I/F 311 externally outputs data generated by the main controller 310. To the external I/F 311 can be mounted a detachable recording medium 320, and the program 3021 may be stored in the recording medium 320 or distributed via an external communications apparatus.

Moreover, the controller 300 includes a head drive controller 312, a main scanning drive unit 313, a sub-scanning drive unit 314, a sheet feeding drive unit 315, a sheet discharging drive unit 316, and a scanner controller 317. The head drive controller 312 controls for each of the recording heads 21-24 whether an ejection is made, and a liquid droplet ejection timing and ejection amount in case the ejection is made. The head drive controller 312, which includes an ASIC (a head driver) for generating, aligning, and converting head data for driving and controlling the recording heads 21-24, generates, based on printing data (dot data to which a dithering process, etc., is applied), a drive signal which indicates the presence/absence of the liquid droplet and sizes of the liquid droplets to supply the generated drive signal to the recording heads 21-24. With the recording heads 21-24 including a switch for each nozzle and being turned on and off based on the drive signal, the recording heads 21-24 cause a liquid droplet of a specified size to impact at a position of the sheet material 150 specified by the printing data. The head driver of the head drive controller 312 may be provided on the recording head 21-24 side or the head drive controller 312 and the recording heads 21-24 may be integrated. The configuration shown is an example.

The main scanning drive unit (a motor driver) 313 drives the main scanning motor 8 which moves the carriage 5 to scan. To the main controller 310 is connected the encoder sensor 42 which detects the above-described carriage position, and the main controller 310 determines a position in the main scanning direction of the carriage 5 based on this output signal. Then, the main scanning motor 8 is driven and controlled via the main scanning drive unit 313 to move the carriage 5 in both of the main scanning directions.

The sub-scanning drive unit (motor driver) 314 drives a sub-scanning motor 132 for conveying a sheet of paper. To the main controller 310 is input an output signal (a pulse) from a rotary encoder sensor 131 which detects an amount of movement in the sub-scanning direction; the main controller 310, based on this output signal, detects an amount of sheet conveying, and drives and controls the sub-scanning motor 132 via the sub-scanning drive unit 314 to convey the sheet material via a conveying roller (not shown).

The sheet feeding drive unit 315 drives a sheet feeding motor 133 which feeds a sheet material from a sheet feeding tray. The sheet discharging drive unit 316 drives a sheet discharging motor 134 which drives a roller for discharging a printed sheet material 150 onto the platen. The sheet discharging drive unit 316 may be replaced with the sub-scanning drive unit 314.

The scanner controller 317 controls an image reading unit 135. The image reading unit 135 optically reads a manuscript and generates image data.

Moreover, to the main controller 310 is connected an operation/display unit 136 which includes various displays and various keys such as ten keys, a print start key, etc. The main controller 310 accepts a key input which is operated by a user via the operation/display unit 136, displays a menu, etc.

In addition, although not shown, there may also be included a recovery drive unit for driving a maintenance and recovery motor which drives the maintenance mechanism 26, a solenoid driving unit (driver) which drives various solenoids (SOLs), and a clutch driving unit which drives electromagnetic cracks, etc. Moreover, a detected signal of other various sensors (not shown) is also input to the main controller 310, but illustrations thereof are omitted.

The main controller 310 performs a process of forming the test pattern on the sheet material and performs light emission drive control on the formed test pattern, which causes a light emitting element of the print position offset sensor 30 mounted on the carriage 5 to emit a light. Then, an output signal of the light receiving element is obtained, the reflected light of the test pattern is electrically read, an impacting position offset amount is detected from the read results, and, furthermore, a control process is performed in which a liquid droplet ejection timing of recording heads 21-24 is corrected based on an impacting position offset amount such that there would be no impacting position offset.

(Correction of Impacting Position Offset)

Figure 9:
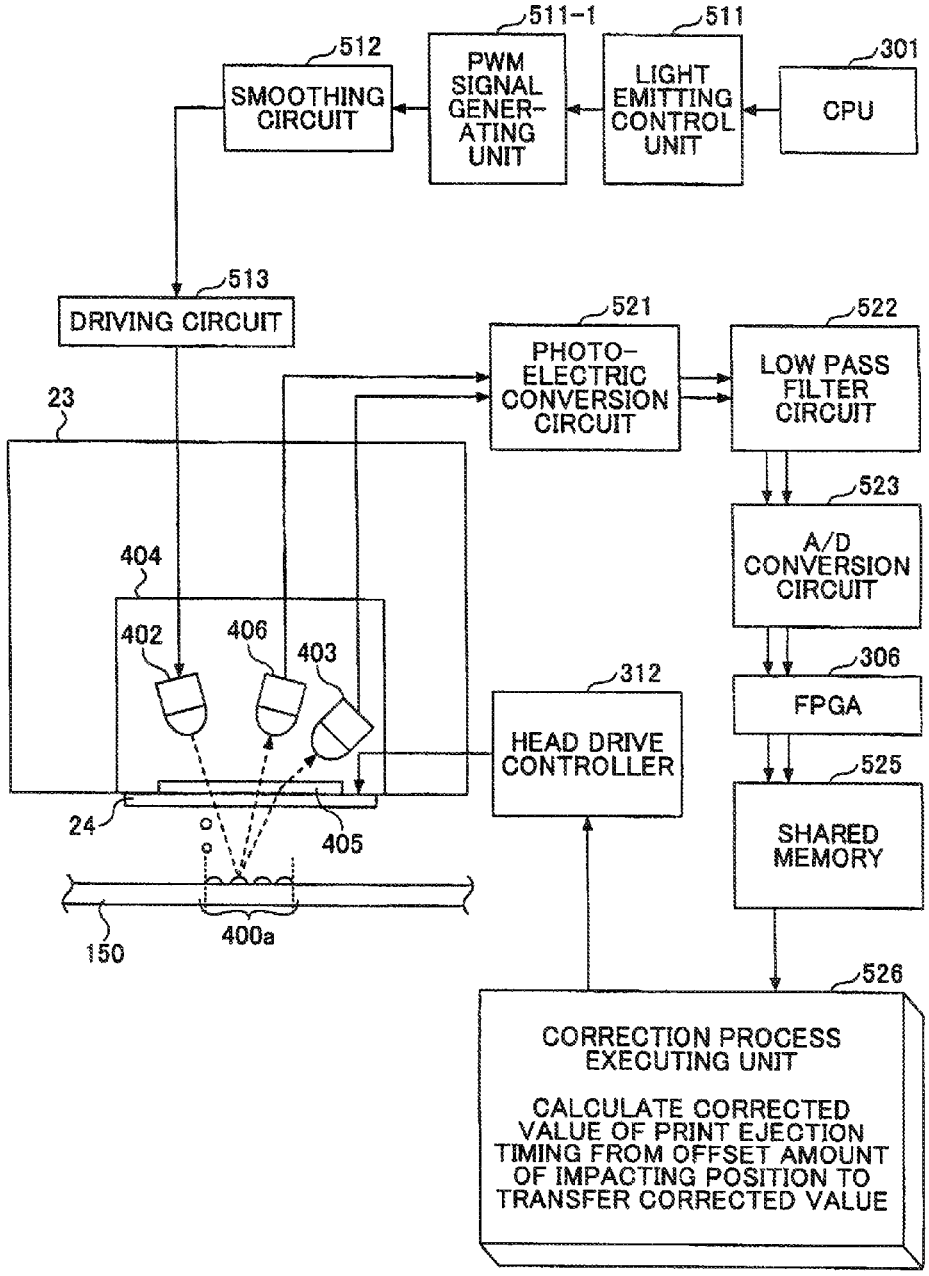
FIG. 9 is an exemplary diagram which schematically shows a configuration for a print position offset sensor to detect an edge of the test pattern.

FIG. 9 is an exemplary diagram which schematically shows a configuration for the print position offset sensor 30 to detect an edge position of a test pattern. FIG. 9 shows the recording head 21 and the print position offset sensor 30 in FIG. 5 that are viewed from the right side face plate 4.

The print position offset sensor 30 includes a light emitting element 402 and light receiving elements 403 and 406 which are aligned in a direction orthogonal to the main scanning directions. Arrangements of the light emitting element 402 and the light receiving elements 403 and 406 may be reversed. The light emitting element 402 projects a below-described spotlight onto a test pattern 400*a*, so that one of the receiving elements 403 and 406 receives a regular reflected light which is reflected to the sheet material 150, while the other thereof receives a diffuse reflected light such as a reflected light from the platen 40, other scattered lights, etc. The light emitting element 402 and the light receiving elements 403 and 406 are fixed to inside a housing 404 and a face which opposes the platen 40 of the print position offset sensor 30 is shielded from outside with a lens 405. In this way, the print position offset sensor 30 is packaged, so that it may be distributed as a unit.

Within the print position offset sensor 30, the light emitting element 402, and the light receiving elements 403 and 406 are arranged in a direction orthogonal to the scanning directions of the carriage 5 (are arranged in a direction parallel to a sub-scanning direction). This makes it possible to reduce an impact, on detected results, of a moving speed change of the carriage 5.

For the light emitting element 402, an LED may be adopted, for example; however, the light emitting element 402 may be a light source (e.g., a laser, various lamps) which can project a visible light. The visible light is used in order to enable the spotlight to be absorbed by the test pattern. While a wavelength of the light emitting element 402 is fixed, multiple print position offset sensors 30 can be mounted that have light emitting elements 402 of different wavelengths.

Moreover, a diameter of a spot formed by the light emitting element 402 is in the order of mms for using an inexpensive lens without using a high precision lens. For this spot diameter, which is related to an accuracy of detecting an edge of a test pattern, even when it is in the order of mms, an edge position may be detected with sufficiently high accuracy as long as the edge position is determined according to the present embodiment. The spot diameter can also be made smaller.

When certain timing is reached, the CPU 301 starts an impacting position offset correction. The above-mentioned timing includes, for example, timing at which an impacting position offset correction is instructed from the operation/display unit 136 by the user; timing at which a material is determined by the CPU 301 to be made of a certain sheet material 150 as an intensity of a light reflected at the time the light emitting element 402 emits a light before ink is ejected is no more than a predetermined value, timing at which either of a temperature and a humidity which are stored when an impacting position offset correction is performed is offset by at least a threshold value, periodic (daily, weekly, monthly, etc.) timing, etc.

An impacting position offset correction according to the present embodiment is a two stage process including a process before a test pattern is formed and a process after the test pattern is formed. However, the main difference is whether the test pattern is formed, so that a case in which the test pattern is formed is described here.

The CPU 301 instructs the main scanning controller 313 to move the carriage 5 in both directions and instructs the head drive control unit 312 to eject liquid droplets with a predetermined test pattern as printing data. While the main scanning controller 313 moves the carriage 5 in both of the main scanning directions relative to the sheet material 150, the head drive controller 312 causes liquid droplets to be ejected from the recording head 21 to form a test pattern which includes at least two independent lines.

Moreover, the CPU 301 performs control for reading, by the print position offset sensor 30, the test pattern formed on the sheet material 150. More specifically, a PWM value (mainly a duty ratio) for driving the light emitting element 402 of the print position offset sensor 30 is set in a light emitting controller 511 by the CPU 301, and the light emitting controller 511 causes a PWM signal generating unit 511-1 to generate a PWM signal according to the PWM value. The PWM signal generated by the PWM signal generating unit 511-1 is smoothed at a smoothing circuit 512, so that the smoothed result is provided to a driving circuit 513. The driving circuit 513 drives the light emitting element 402 to emit a light, so that a spotlight is irradiated from the light emitting element 402 onto a test pattern of the sheet material 150. The light emitting control unit 511, the smoothing circuit 512, the driving circuit 513, a photoelectric conversion circuit 521, a low-pass filter circuit 522, an A/D conversion circuit 523, and a correction process executing unit 526 are installed in the main controller 310 or the controller 300. The shared memory 525 is the RAM 303, for example.

A spotlight from the light emitting element 402 is irradiated onto a test pattern on a sheet material, so that a reflected light which is reflected from the test pattern is incident on the light receiving elements 403 and 406. The light receiving elements 403 and 406 output an intensity signal of the reflected light to the photoelectric conversion circuit 521. As described below, the photoelectric conversion circuit 521 can switch between multiplying factor registers for the light receiving elements 403 and 406. In the multiplying factor register, which includes 4 to 16 bits, for example, an output voltage of the light receiving elements 403 and 406 is increased in accordance with a set value. For example, in case of 4 bits with "0001" being a normal state, when set to "0010", the output voltage is doubled, while, when set to "0011", the output voltage is tripled. Moreover, an arbitrary multiplying factor may be set such that the output voltage is multiplied by 1.5 when set to "0010", the output voltage is doubled when set to "0011", etc. In this way, the multiplying factor may be increased to increase sensitivity of the light receiving elements 403 and 406.

More specifically, the photoelectric conversion circuit 521 photoelectrically converts the intensity signal so as to output the photoelectrically converted signal (a sensor output voltage) to the low-pass filter circuit 522. The low-pass filter circuit 522 removes a high-frequency noise portion and then outputs the photoelectrically converted signal to the A/D conversion circuit 523. The A/D conversion circuit 523 A/D converts the photoelectrically converted signal and outputs the A/D converted signal to the signal processing circuit (FPGA) 306. The signal processing circuit (FPGA) 306 stores the output voltage data sets which are digital values of the A/D converted output voltage into the shared memory 525.

The correction process executing unit 526 reads the output voltage data sets stored in the shared memory 525, performs an impacting position offset correction, and sets them in the head drive controller 312. In other words, the correction process executing unit 526 detects an edge position of a test pattern to compare with an optimal distance between two lines to calculate an impacting position offset amount. The correction process executing unit 526 is realized by the CPU 301 executing programs, or by an IC, etc.

The correction process executing unit 526 calculates a correction value of a liquid droplet ejection timing, at which the recording head 21 is driven such that the impacting position offset is removed, to set the calculated correction value of the liquid droplet ejection timing in the head drive controller 312. The below-described sensor calibration is also performed in the correction process executing unit 526. In this way, when driving the recording head 21, the head drive controller 312 corrects the liquid droplet ejection timing based on the correction value to drive the recording head 21, making it possible to reduce the impacting position offset of the liquid droplets.

Figure 10:
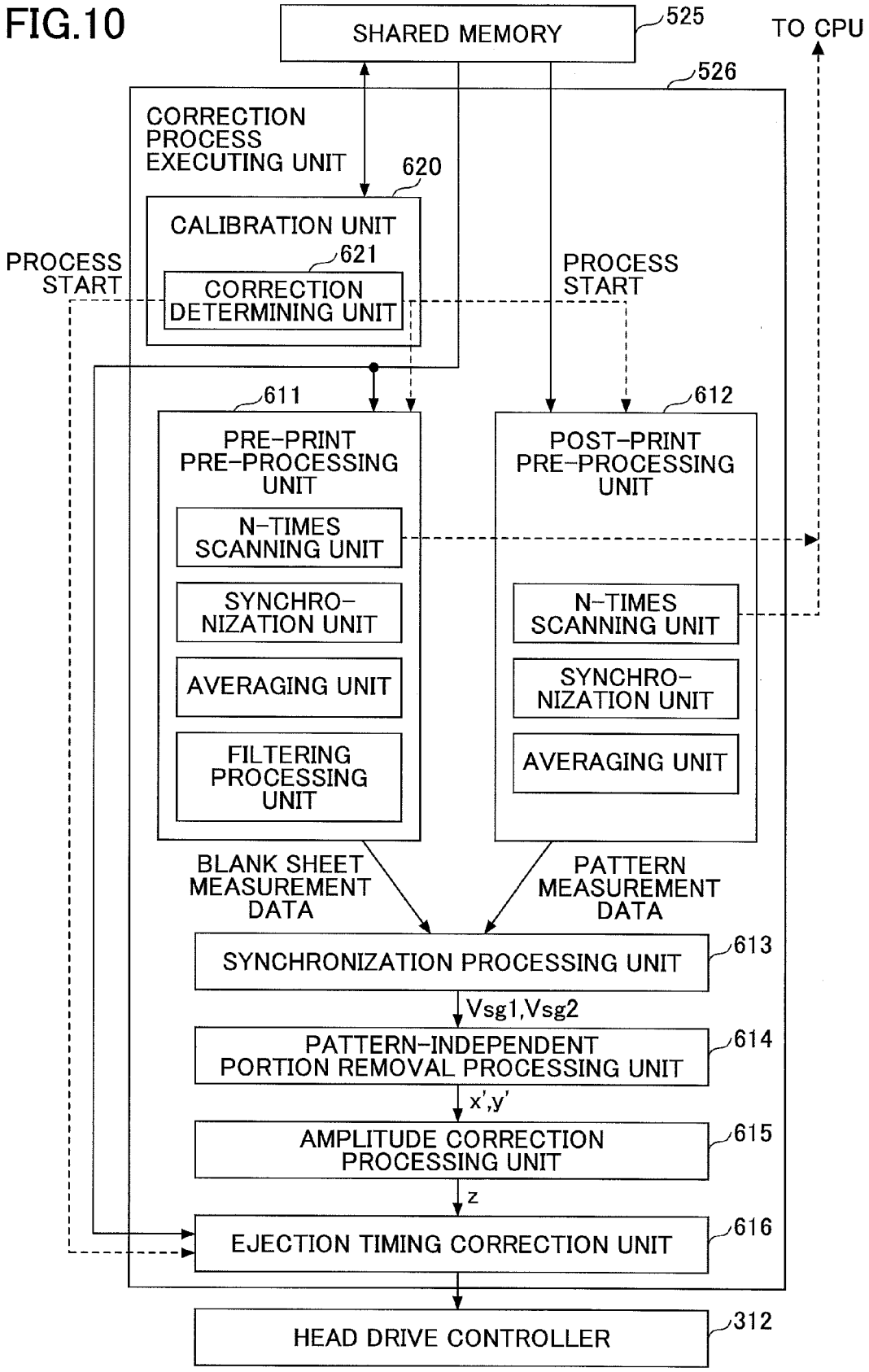
FIG. 10 is an exemplary functional block diagram of a correction process execution unit.

FIG. 10 is an exemplary functional block diagram of the correction processing executing unit 526. The correction process executing unit 526 includes a pre-print pre-processing unit 611, a post-print pre-processing unit 612, a synchronization processing unit 613, a pattern-independent portion removal unit 614, an amplitude correction processing unit 615, and an ejection timing correction unit 616. Moreover, it includes a calibration unit 620 and a correction determining unit 621. The pre-print pre-processing unit 611 applies pre-processing to output voltage data before the test pattern is formed, while the post-print pre-processing unit 612 applies pre-processing to output voltage data after the test pattern is formed. The synchronization processing unit 613 synchronizes (aligns) the output voltage data before the test pattern is formed and the output voltage data after the test pattern is formed. The pattern-independent portion removal unit 614 subtracts Vp from the output voltage data. The amplitude correction processing unit 615 performs an amplitude correction process to generate data z to be operated on, which data are for computing an edge position. The ejection timing correction unit 616 corrects the liquid droplet ejection timing based on an impacting position offset amount which is determined from the line center of the test pattern. These processes will be described below in detail.

(Spotlight Position and Edge Position)

Figure 11:
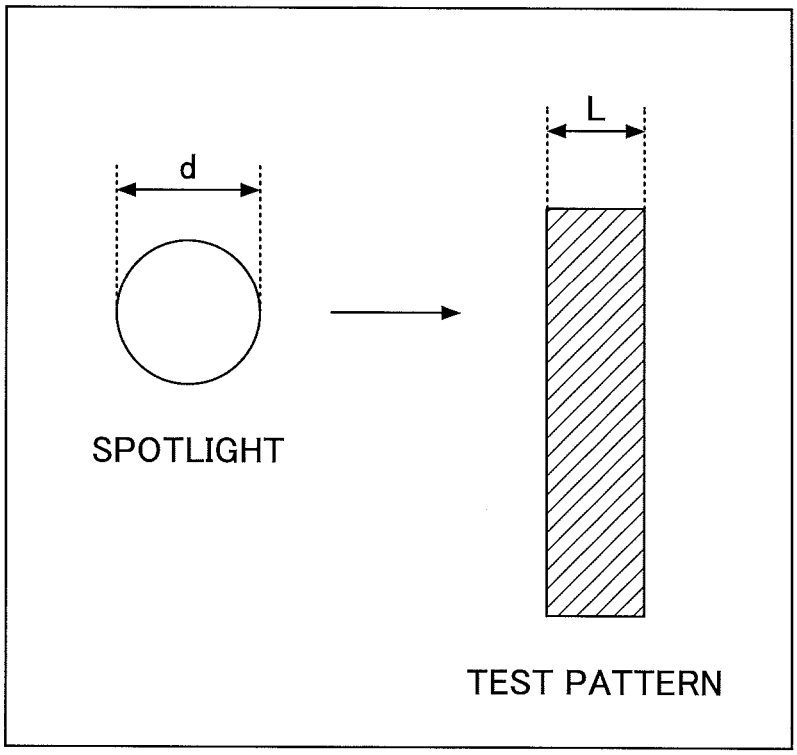
FIG. 11 is a diagram illustrating an example of a spotlight and the test pattern.

Next, a relationship between a spotlight and an edge position is described using FIG. 11. FIG. 11 is a diagram illustrating an example of the spotlight and a test pattern. The spotlight moves such that it crosses multiple lines (one line shown) which make up the test pattern at a constant speed (equal speeds). Below, explanations are given without strictly distinguishing between the test pattern and the line. Crossing may be conducted at a variable speed; however, the speed while crossing is equal in the present example. As a sheet material such as a sheet of paper moves in a longer direction of the line through sheet feeding, the spotlight moves such that it crosses the line obliquely; however, even when the sheet material stops, a method of specifying the edge position is the same. With the sheet material and the spotlight of a common wavelength, it can be said that a reflected light of the spotlight decreases the larger an overlapping area of the test pattern becomes.

In FIG. 11, it is assumed that spot diameter d=line width L of a test pattern. In actuality, while a spotlight becomes somewhat elliptical, it has a long axis parallel to the test pattern, so that a shape of the spotlight has almost no impact on accuracy of the edge position.

Figure 12:
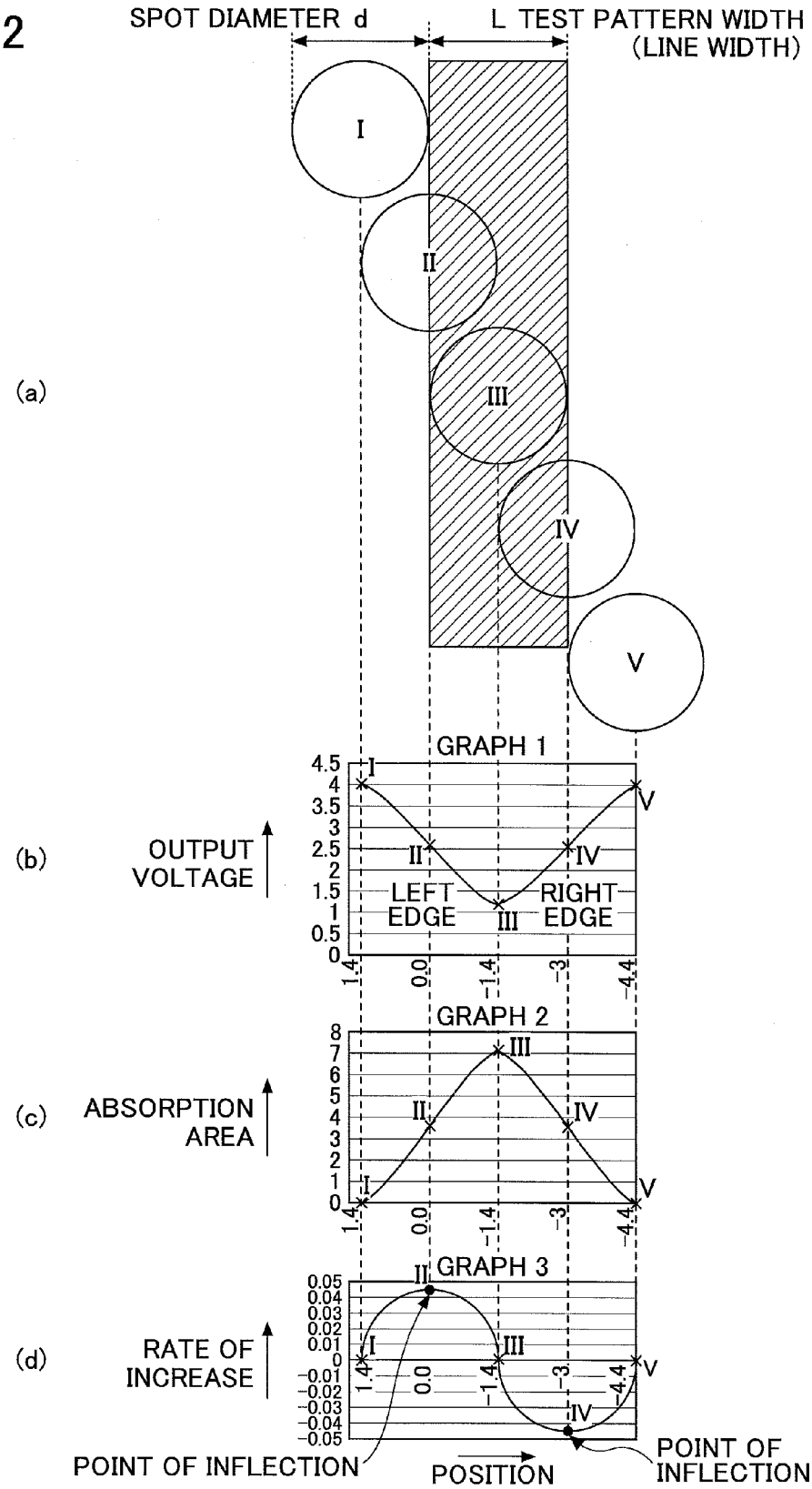
FIG. 12 is a diagram illustrating an example of the spotlight and the test pattern.

FIG. 12 is an exemplary diagram which describes an outline for specifying the edge position of the present embodiment. Letters I-V in (a) in FIG. 12 show a time lapse, where an elapsed time is longer for the lower spotlight:

Time I: The spotlight and the test pattern do not overlap;

Time II: A half of the spotlight overlaps the test pattern. At this moment, a rate of decrease of the reflected light becomes the largest. (An overlapping area positively changes most in a unit time.);

Time III: The whole of the spotlight overlaps the test pattern. At this moment, an intensity of the reflected light becomes the smallest; and Time IV: A half of the spotlight overlaps the test pattern. At this moment, a rate of increase of the reflected light becomes the largest. (An overlapping area negatively changes most in the unit time.)

A centroid of the spotlight matches the edge position of the line of the test pattern at the Times II and IV. Therefore, if the fact that the spotlight and the line have such a relationship at the Times II and IV may be detected from the reflected light, the edge position may be specified accurately.

FIG. 12 (in (b)) shows an exemplary output voltage of a light receiving element, FIG. 12 (in (c)) shows an exemplary absorption area (an overlapping area of the spotlight and the test pattern), and FIG. 12 (in (d)) shows an exemplary rate of increase of the absorption area, which rate of increase is a derivative of the absorption area of FIG. 12 (in (c)). For FIG. 12 (in (d)), equivalent information may be obtained even when a derivative of an output waveform of FIG. 12 (in (b)) is taken. Moreover, the absorption area may be calculated from the output voltage, for example, but it does not have to be an absolute value, so that, for the absorption area of FIG. 12 (in (c)), the same waveform as the absorption area may be obtained by subtracting the output voltage of FIG. 12 (in (b)) from a predetermined value.

As described above, the rate of decrease of the reflected light in the Time II becomes the largest (the overlapping area positively changes most in a unit time), and the rate of increase of the reflected light in the Time IV becomes the largest (the overlapping area negatively changes most in the unit time). Then, as shown in FIG. 12 (in (d)), a point at which the rate of increase changes from an increasing trend to a decreasing trend matches the Time II and a point at which the rate of increase changes from the decreasing trend to the increasing trend matches the Time IV.

The point at which a change from the positive trend to the negative trend occurs or the reverse occurs is a point at which a turning direction changes in a curved line on a plane, or a point of inflection. In light of the above, when an output signal demonstrates the point of inflection, it means that the spotlight matches the edge position of the test pattern. Therefore, when the point of inflection is accurately detected, the position of the edge may also be accurately specified.

While it is arranged that a spot diameter d=a line width L of a test pattern in FIG. 12, an edge position can be detected even with "the spot diameter d>the line width L of the test pattern" or "the spot diameter d<the line width L of the test pattern".

(Specification of Edge Position)

Figure 13A:
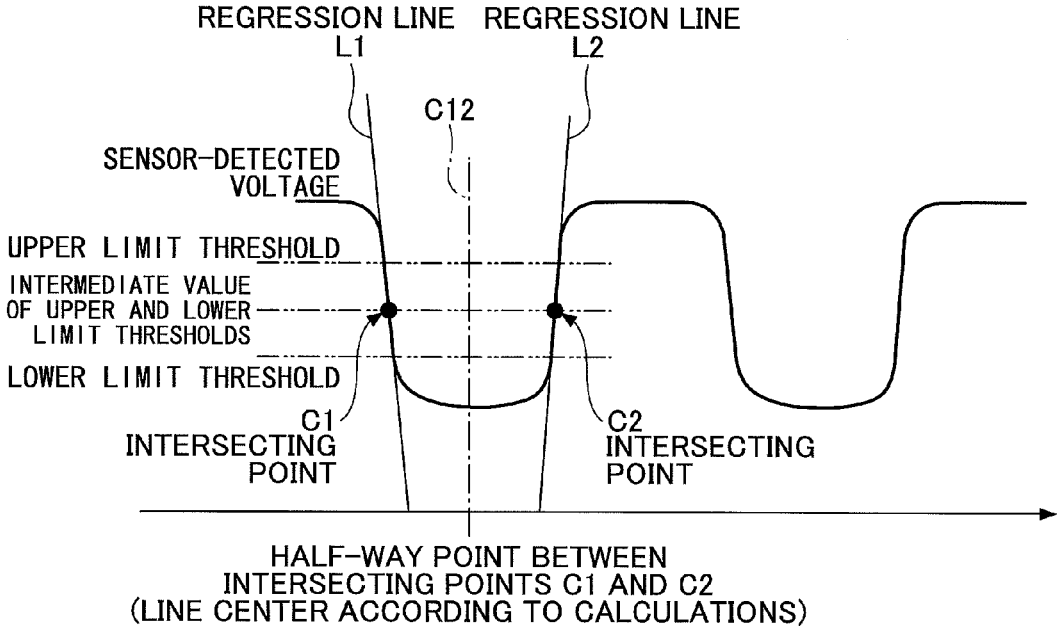
FIGS. 13A and 13B are exemplary drawings for explaining a method of specifying an edge position (a line center)
Figure 13B:
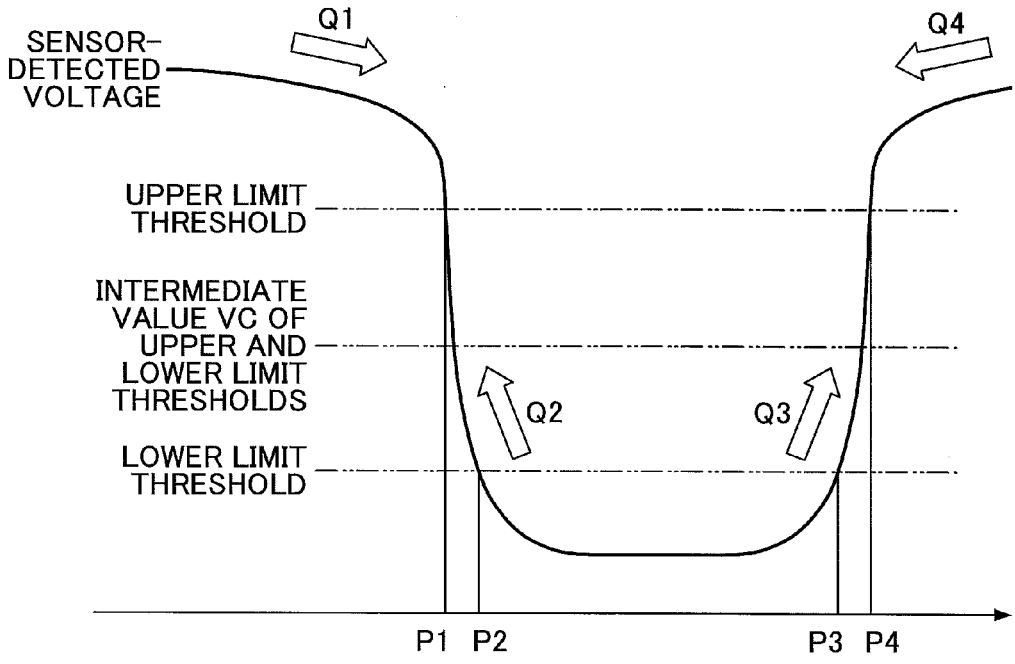

FIGS. 13A and 13B are exemplary diagrams which describe a method of specifying an edge position (a line center). FIG. 13A shows a schematic diagram of an output voltage, while FIG. 13B shows an expanded view of the output voltage. An approximate value of a point of inflection may be experimentally determined by the correction process executing unit 526 or a developer. As described above, it is a position at which a slope is closest to zero when a derivative of the output voltage or the absorption area is taken, for example.

An upper limit threshold Vru and a lower limit threshold Vrd of the output voltage are predetermined such that this point of inflection is included. As described below, the CPU 301 calibrates an output of the light emitting element 402 and a sensitivity of the light receiving element 403 such that the output voltage takes almost the same constant value (below-described 4 V) for a region without a test pattern. An amplitude correction process may cause local maximum values of the output voltage to take almost the same constant value, so that the point of inflection is included between the upper limit threshold Vru and the lower limit threshold Vrd even when the output voltage is unstable.

The ejection timing correction unit 616 searches a falling portion of the output voltage in an arrow-indicated Q1 direction to store a point at which the output voltage is no more than the lower limit threshold Vrd as a point P2. Next, it searches the same in an arrow-indicated direction Q2 from the point P2 to store a point at which the output voltage exceeds the upper limit threshold Vru as a point P1.

Then, using multiple output voltage data sets between the point P1 and the point P2, a regression line L1 is calculated and an intersecting point of the regression line L1 and an intermediate value Vrc of the upper and lower thresholds is calculated and is set as an intersecting point C1.

Similarly, the ejection timing correction unit 616 searches a rising portion of the output voltage in an arrow-indicated Q3 direction to store a point at which the output voltage is no less than the lower limit threshold Vru as a point P4. Next, it searches the same in an arrow-indicated direction Q4 from the point P4 to store a point at which the output voltage is no more than the upper limit threshold Vrd as a point P3.

Then, using multiple output voltage data sets between the point P3 and the point P4, a regression line L2 is calculated and an intersecting point of the regression line L2 and an intermediate value Vrc of the upper and lower thresholds is calculated and is set as an intersecting point C2. The ejection timing correction unit 616 specifies the intersecting points C1 and C2 as respective edge positions of two lines. According to a determining process of the upper and lower thresholds, the intersecting points C1 and C2 may be arranged to approximately match the point of inflection.

The intersecting points C1 and C2 are the edge positions of the two lines, so that a center of the intersecting points C1 and C2 is a line center C12.

Thereafter, the ejection timing correction unit 616 determines the line center of the multiple lines, and calculates a difference between an ideal distance between the two lines of the test pattern and a distance between the line centers. This difference is an impacting position offset amount of a position of an actual line relative to a position of an ideal line. Based on the calculated impacting position offset amount, the ejection timing correction unit 616 calculates a correction value for correcting timing for causing liquid droplets to be ejected from the recording head 21 (liquid ejection timing) and sets the correction value in the head drive controller 312. In this way, the head drive controller 312 drives the recording head 21 with the corrected liquid ejection timing, so that the impacting position offset is reduced.

(Accuracy Decreasing Factor)

In this way, for detecting an edge using output voltage data between an upper limit threshold and a lower limit threshold, the edge cannot be detected unless at least a point of inflection is included between the upper limit threshold and the lower limit threshold. A width formed by the upper limit threshold and the lower limit threshold (two thresholds) is called a "threshold area". The threshold area, which has the output voltage as a unit, may also be defined as an absorption area which corresponds to the output voltage.

Figure 14:
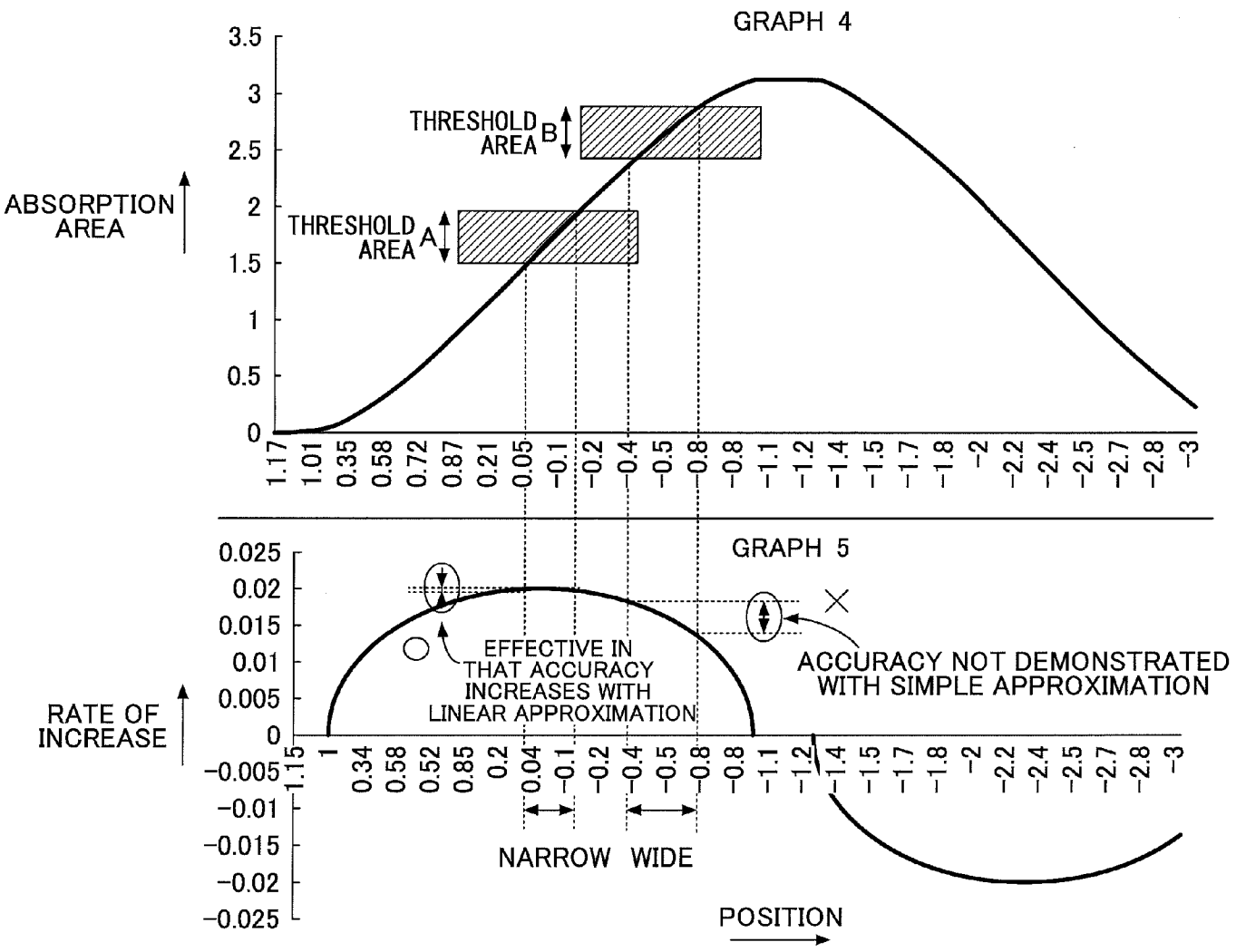
FIG. 14 is a diagram illustrating one example of an absorption area and an increase rate of the absorption area.

FIG. 14 is a diagram illustrating examples of an absorption area and an increase rate of the absorption area. As described in FIGS. 12 to 13B, when there is a point of inflection in a threshold area A in FIG. 14, the ejection timing correction unit 616 may accurately detect an edge position.

On the other hand, when there is a point of inflection in a threshold area B in FIG. 14, the ejection timing correction unit 616 may not detect an accurate edge position even though a regression line is determined from the threshold area A. Moreover, if it is known that a point of inflection is in the threshold area B, the threshold area may be moved from A to B in order for the ejection timing correction unit 616 to determine the regression line; however, a position of the point of inflection being greatly offset means that curves of the absorption area and the output voltage could be deformed. For example, when the ejection timing correction unit 616 determines a regression line from a threshold area with a large slope of the curve, the intersecting points C1 and C2 may also be greatly offset. This is indicated by a lower portion of FIG. 14 showing that, while a width of a position which includes the vicinity of an apex may be estimated in a sufficiently narrow range in the threshold area A, it is difficult to estimate a width of a position which includes the vicinity of a point of inflection (which is not within a threshold area B in FIG. 14).

Therefore, it is seen that, when an amplitude of the output voltage changes such that a point of inflection is not in the threshold area A, it is not preferable to specify an edge position from the threshold area A or to move a threshold area such that a point of inflection is included therein to determine an edge position.

Thus, the correction process executing unit 526 according to the present embodiment corrects amplitude of the output voltage in a generally constant manner to cause the point of inflection to be included in the threshold area to accurately detect the edge position.

Figure 15A:
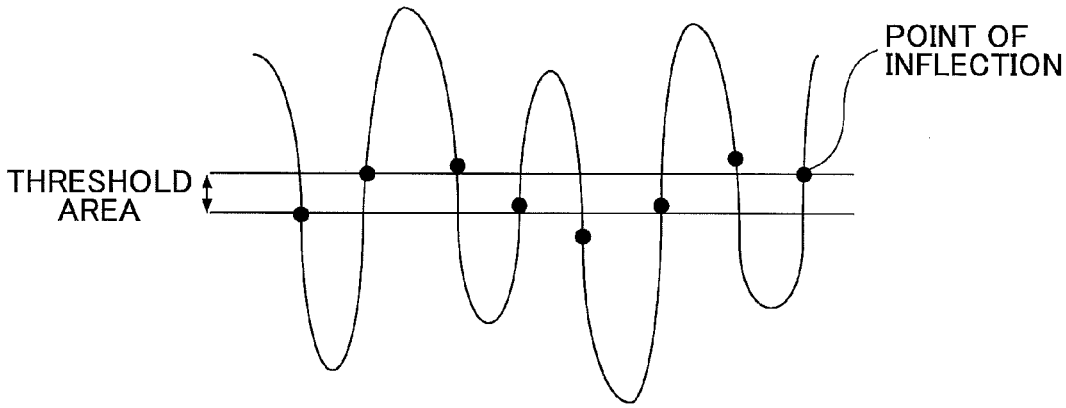
FIGS. 15A and 15B are diagrams illustrating one example of a detected voltage having unstable amplitude and of a detected voltage after correcting the amplitude.
Figure 15B:
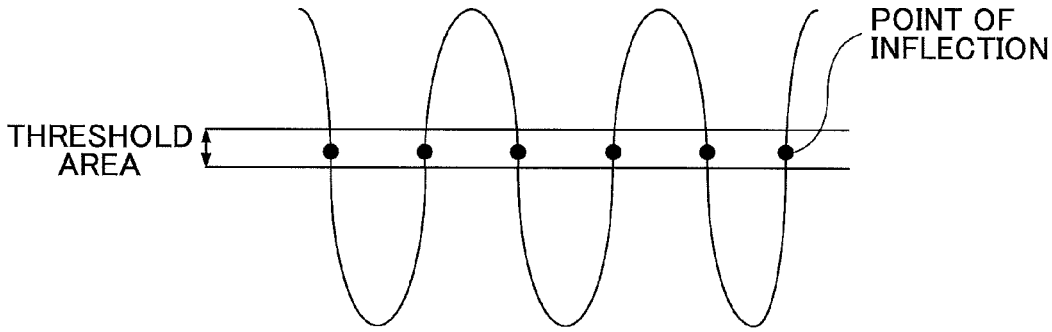

FIG. 15A shows an example of an output voltage which is unstable, while FIG. 15B shows an example of an output voltage after its amplitude is corrected. The output voltage as shown in FIG. 15A is not commonly obtained; however, it is known that an amplitude varies when a print position offset sensor 30 reads a test pattern which is formed on a highly transmittant sheet material 150 such as a tracing paper. As shown, when the amplitude becomes unstable, the point of inflection falls off the threshold area. When the correction process executing unit 526 determines the intersecting points C1 and C2 with the threshold area are not moved, the intersecting points C1 and C2 are determined from an output voltage which does not include a point of inflection, so that the edge position ends up not being accurate. When the threshold area is moved such that it includes a point of inflection, there is no guarantee that an edge position may be accurately determined with a method of determining the intersecting points C1 and C2 before moving the threshold area.

On the other hand, as shown in FIG. 15B, local maximum values of the amplitude can be aligned to cause the point of inflection to be included in the threshold area and to cause the points of inflection to be concentrated in the vicinity of the center of the threshold area. In this way, in the same manner as the threshold A in FIG. 14, the ejection timing correction unit 616 may accurately detect an edge position with a simple approximation of determining a regression line.

While a tracing paper is used as an example in the present embodiment, the same problem arises for a highly transmittant sheet material 150. For example, the method of detecting the edge position according to the present embodiment is effective when paper is sufficiently thin even for plain paper other than tracing paper. Therefore, a process of correcting a liquid droplet ejection timing according to the present embodiment is not limited to a sheet material 150 made of a specific material, kind, or thickness. Moreover, it may be applied to a plain paper with a sufficient thickness.

(Case of Line-Type Image Forming Apparatus)

While the serial-type image forming apparatus 100 in FIGS. 4 and 5 is described as an example in the present embodiment, an impacting position offset amount may be corrected with the same method in the line-type image forming apparatus 100. The line-type image forming apparatus 100 is briefly described.

Figure 16:
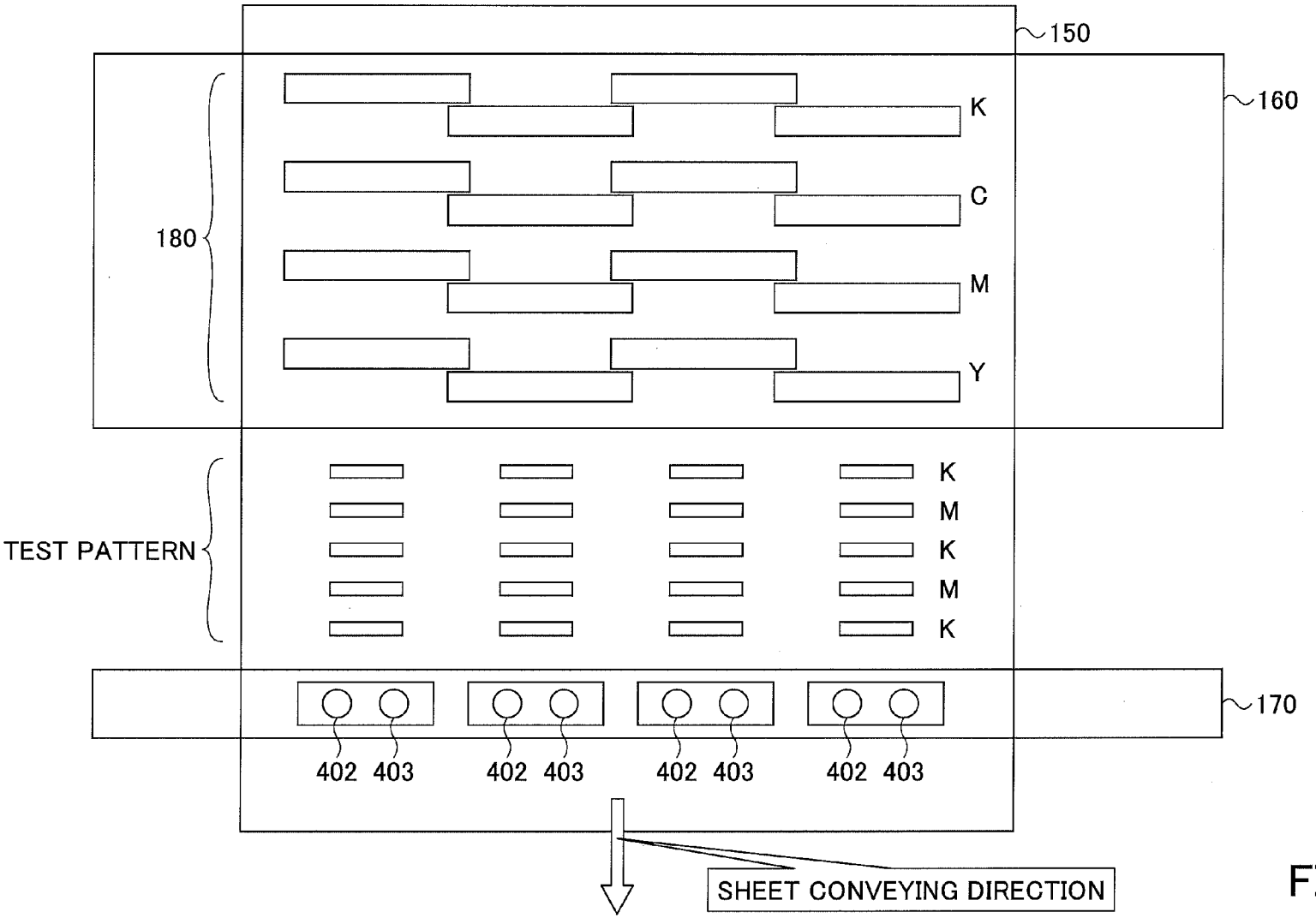
FIG. 16 is an exemplary diagram which schematically explains test patterns and an arrangement of heads of a line-type image forming apparatus.

FIG. 16 is an exemplary diagram which schematically describes a test pattern and an arrangement of a head of the line-type image forming apparatus 100. A head fixing bracket 160 is fixed such that it is stretched from end to end in the main scanning directions orthogonal to a sheet material conveying direction. At the head fixing bracket 160 is arranged a recording head 180 of ink of KCMY from an upstream side to the whole area in the main scanning directions. The recording head 180 of the four colors is arranged in a staggered fashion such that edges overlap. In this way, liquid droplets are ejected to obtain a sufficient resolution even at an edge of the recording head 180, making it possible to suppress an increase in cost without a need to arrange one recording head 180 in the whole area in the main scanning directions. One recording head 180 may be arranged in the whole area in the main scanning directions for each color, or an overlapped area in the main scanning directions of the recording head 180 of each color may be elongated.

Downstream of the head fixing bracket 160 is fixed a sensor fixing bracket 170 such that it is stretched from end to end in the main scanning directions orthogonal to the sheet material conveying direction. At the sensor fixing bracket 170, a number of print position offset sensors 30 are arranged, the number of print position offset sensors 30 being equal to the number of heads. In other words, one print position offset sensor 30 is arranged such that at least a part overlaps one recording head 180 in the main scanning directions. Moreover, one print position offset sensor 30 includes a pair of the light emitting element 402 and the light receiving element 403. The light emitting element 402 and the light receiving element 403 are arranged such that they are nearly parallel to the main scanning direction.

In such an embodiment of the image forming apparatus 100, each line which makes up the test pattern is formed such that a longitudinal direction of the line is parallel to the main scanning direction. When an impacting position offset of a liquid droplet of a different color is corrected with K as a reference, the image forming apparatus 100 forms a K line and an M line, a K line and a C line, and a K line and a Y line. Then, as in the serial-type image forming apparatus 100, an edge position of the CMYK test pattern is detected, and a liquid droplet ejection timing is corrected from the position offset amount.

As described above, even in the line-type image forming apparatus 100, a print position offset sensor 30 may be arranged properly to correct an impacting position offset.

(Signal Correction)

Below, a signal correction of an output voltage according to the present embodiment is described.

Figure 17A:
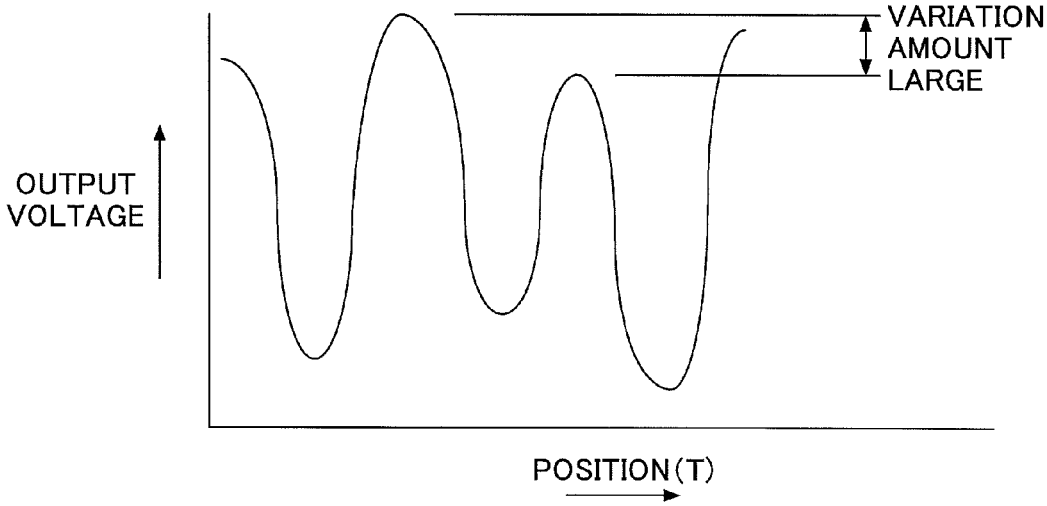
FIGS. 17A and 17B are exemplary drawings for explaining a signal correction.
Figure 17B:
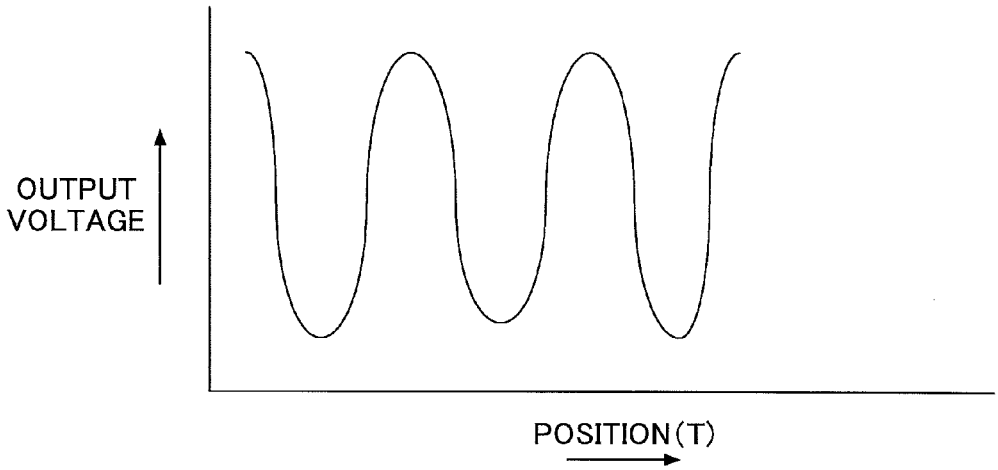

FIG. 17A shows an example of an output voltage of a light receiving element before correcting, while FIG. 17B shows an example of an output voltage after an amplitude thereof is corrected.

FIG. 17A is a waveform of an output voltage when a light receiving element has read a test pattern printed on a highly transmittant sheet material 150 such as a tracing paper. As an intensity of a reflected light of the sheet itself changes, as shown in FIG. 17A, a local maximum value (a portion at which a plain surface is read) and a local minimum value (a portion at which a pattern is read) of the waveform are uneven, so that a variation is large.

FIG. 17B is an example of a waveform of an output voltage after performing a pattern-independent portion removal process and an amplitude correction process. According to the signal correction of the present embodiment, a voltage of a test pattern-independent light received portion is removed and stable output data with a reduced variation of the local maximum and minimum values are obtained. Thus, the subsequent impacting position offset amount is accurately calculated and an impacting position offset is corrected highly accurately.

A signal correction according to the present embodiment includes two correction processes:

Pattern-independent portion removal process; and

Amplitude correction process.

Moreover, a pre-process is needed to perform the signal correction. Thus, the procedure is as follows:

(1) Pre-processing;

(2) Signal correction (2-1) Pattern-independent portion removal process; and (2-2) Amplitude correction process.

(Pre-Processing)

Below, the pre-processing is described. The pre-processing may be divided into a pre-processing A and a pre-processing B. The pre-processing A includes the following processes on output voltage data for a blank sheet status (background) before forming a test pattern.

Pre-Processing A (i) N-times scanning (ii) Synchronization process (iii) Averaging (iv) Filtering process The pre-processing B includes the following processes on output voltage data for a status after forming the test pattern.

Pre-Processing B (i) N-times scanning (ii) Synchronization process (iii) Averaging (Pre-Processing A)

Pre-Processing A-(i)

Figure 18A:
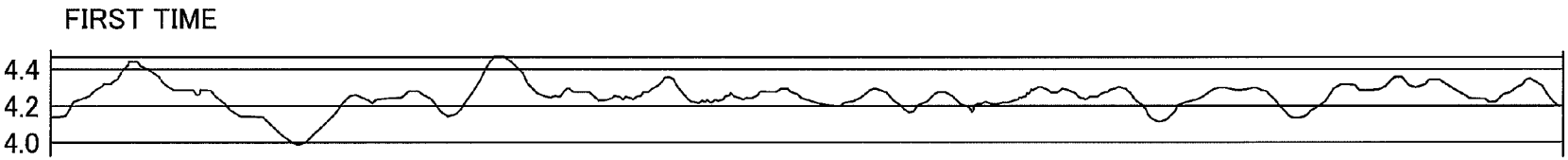
FIGS. 18A and 18B are diagrams illustrating one example of measurement results of scanning n times.
Figure 18B:
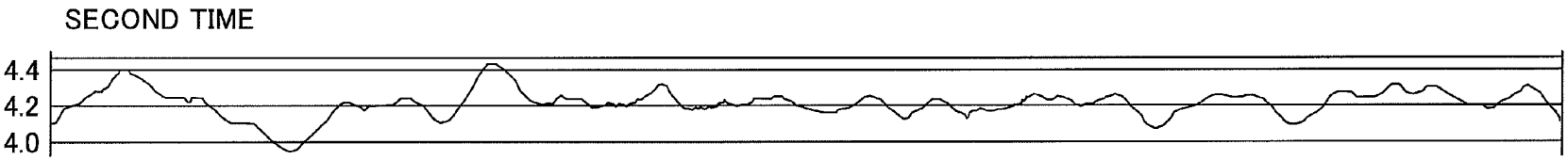

FIGS. 18A and 18B are diagrams illustrating one example of measured results of scanning n times scanning in A-(i). Before the n-time scanning, an n-time scanning unit performs a sensor calibration for a sheet material (e.g., a plain paper, a tracing paper). The n-time scanning unit requests the CPU 301 to cause an output voltage of a reflected light which is detected by a light receiving element and eventually converted by an A/D conversion circuit 523 to take a certain constant value. The CPU 301 performs feedback control such that the output voltage falls within a certain range. For example, when the output voltage is greater than 4.4 V a light emitting amount of the light emission control unit 511 is decreased, while when the output voltage is less than 4.0 V the light emitting amount of the light emission control unit 511 is increased. As shown in FIGS. 18A and 18B, the sensor calibration causes the detected voltage to fall with a 4.0-4.4 V range. A sensor calibration may be performed by a PI control or a PID control with a target value being set to 4.0-4.4 V.

This output voltage is the above-described Vsg2 (an output voltage of an area on which a test pattern is not formed). The n time scanning unit obtains n sets of output voltage data as shown in FIGS. 18A and 18B.

Pre-Processing A-(ii)

Figure 19:
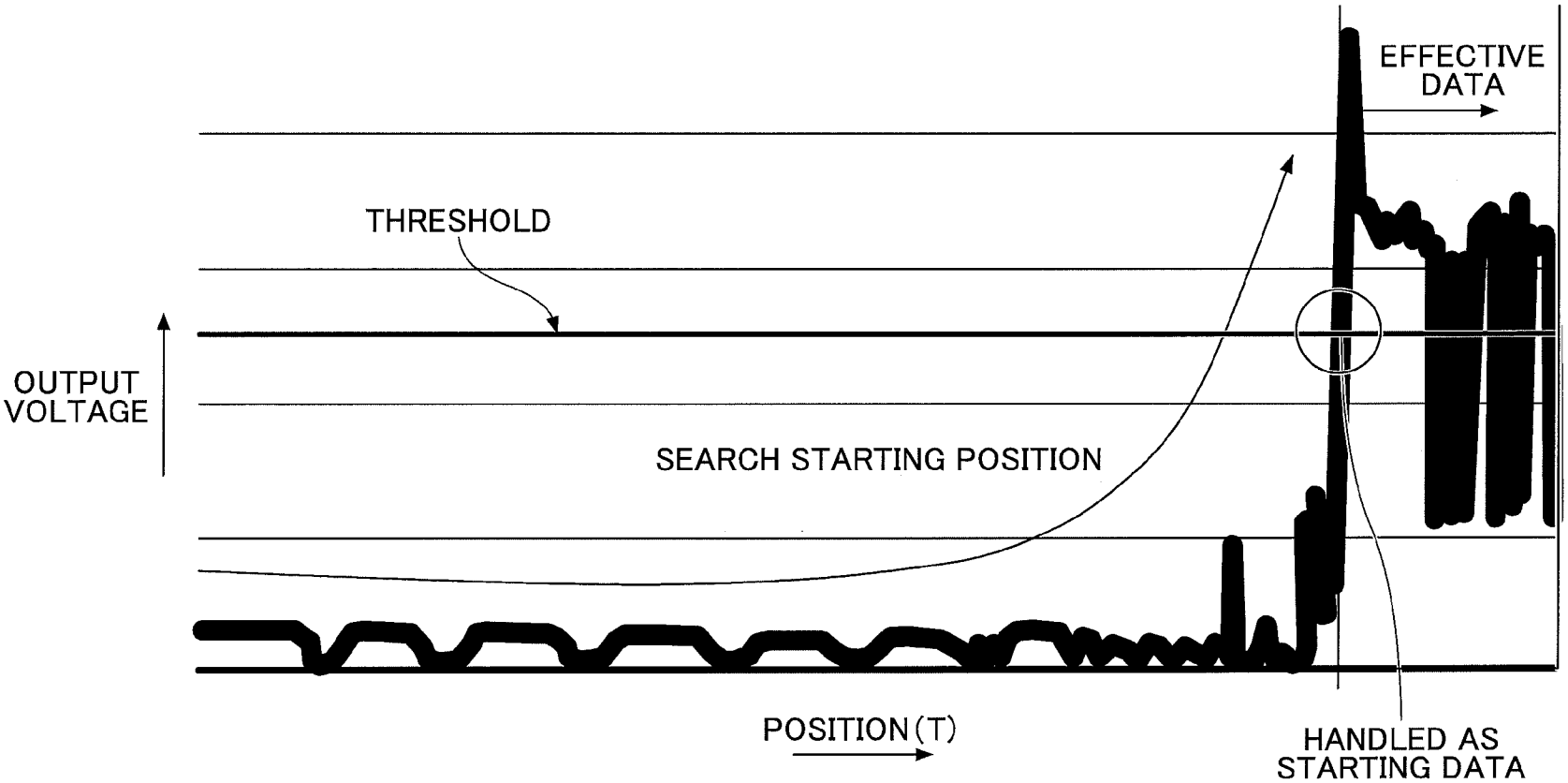
FIG. 19 is an exemplary drawing for explaining a synchronization process.

FIG. 19 is an exemplary diagram which describes a synchronization process of A-(ii). An averaging unit calculates an average of n output voltage data sets which are obtained by the n time scanning unit. The output voltage data sets are detected even when what is other than the sheet material 150 is scanned by the spotlight; however, what is needed is only an output voltage obtained when it scans over the sheet material 150. Therefore, the synchronization unit aligns a start of n output voltage data sets to a sheet edge of the sheet material 150.

In order to start n output voltage data sets from the sheet edge, the synchronization unit detects a point at which the output voltage data first exceeds the threshold value as a sheet edge of the sheet material 150. The output voltage data for averaging are data sets at the time the threshold value is exceeded and beyond. The output voltage data which exceeded the threshold value is handled as a starting first data set. When a target value for the sensor calibration is set to 4.0 V, the threshold value takes a value of around 3.5-3.9 V, which is somewhat smaller.

In addition to such a synchronization method as described above, position information in the main scanning directions that is detected by the encoder sensor 42 may be collated with the output voltage data to store the collated result, and the position information may be matched to synchronize n output voltage data sets.

Pre-Processing A-(iii)

Next, n output voltage data sets include n output voltage data sets for each position with a sheet edge of the sheet material 150 as a reference position (a position being zero) in a scanning direction. The position, which is a position of the carriage 5 that is detected by the encoder sensor, corresponds on a one-on-one basis with a centroid position of the spotlight, so that it is described as the centroid position of the spotlight. In other words, the averaging unit calculates an average of n output voltage data sets for each centroid position.

Pre-Processing A-(iv)

Figure 20:
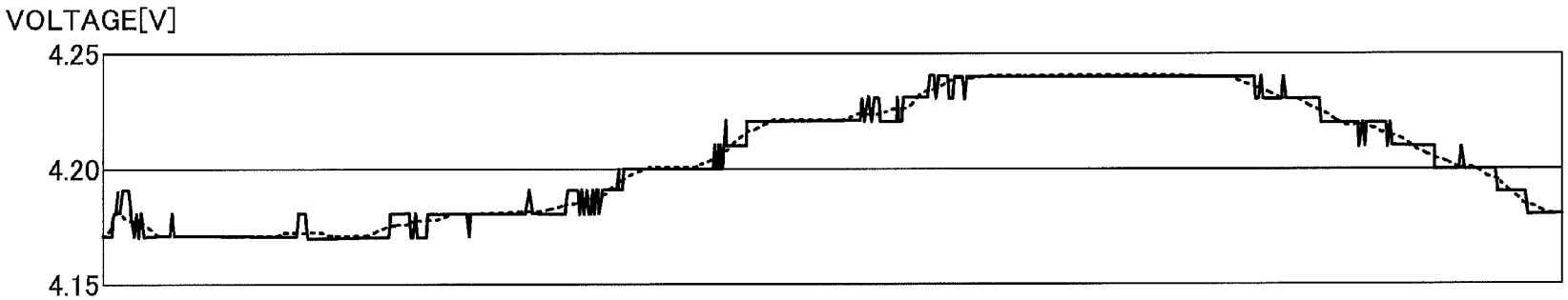
FIG. 20 is an exemplary drawing for explaining a filtering process.

FIG. 20 is an exemplary drawing for explaining a filtering process; a filtering processing unit performs the filtering process on an average value of output voltage data sets for each centroid position that is averaged by the averaging unit. More specifically, m output voltage data sets (m in total, including a targeted data set and data sets preceding and following the targeted data set) are extracted to calculate an average. In this way, a measured noise may be reduced and a mismatch of output voltage data sets which could not be completely synchronized may be reduced.

In FIG. 20, a solid line waveform is output voltage data before the filtering process and a dotted line waveform is output voltage data after the filtering process. It is seen that the output voltage data before the filtering process, which shows step-shaped changes as it is impacted by a resolution of the A/D conversion circuit 523, becomes smooth through the filtering process.

(Pre-Processing B)

Pre-Processing B-(i)

Figure 21A:
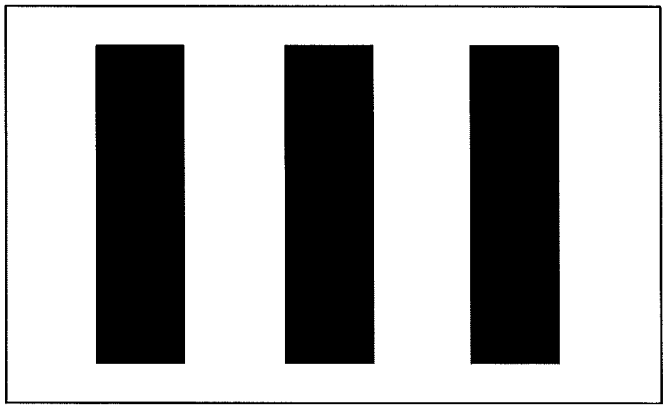
FIGS. 21A and 21B are exemplary drawings for explaining scanning n times.
Figure 21B:
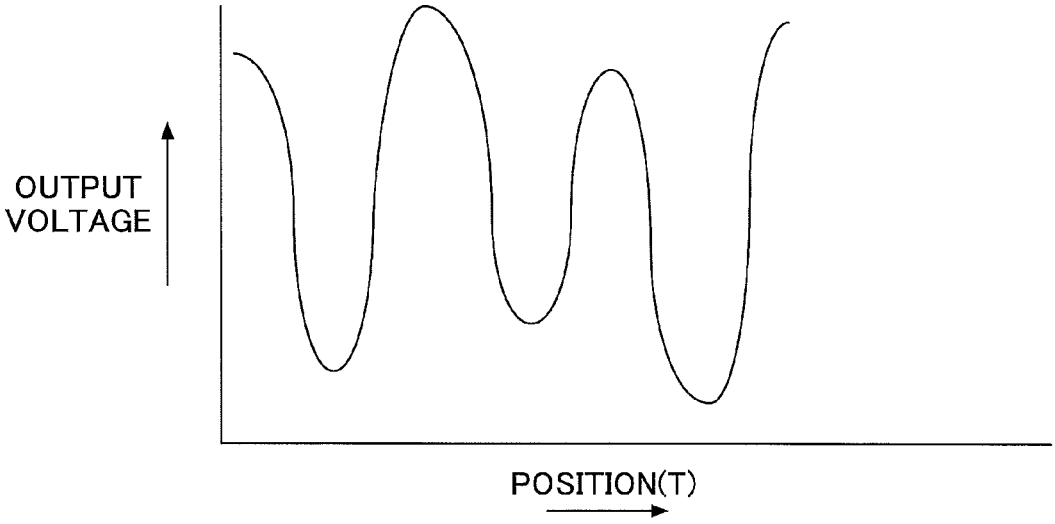

FIGS. 21A and 21B are exemplary diagrams which describe n-times scanning of B-(i). In FIG. 21A, a test pattern is formed on the sheet material 150 on which the n-times scanning of A-(i) has been performed. FIG. 21B shows a waveform of output voltage data when a reflected light from the sheet material 150 on which a test pattern is formed is received by a light receiving element. The n times scanning unit obtains such data n times.

Pre-Processing B-(ii)

Figure 22:
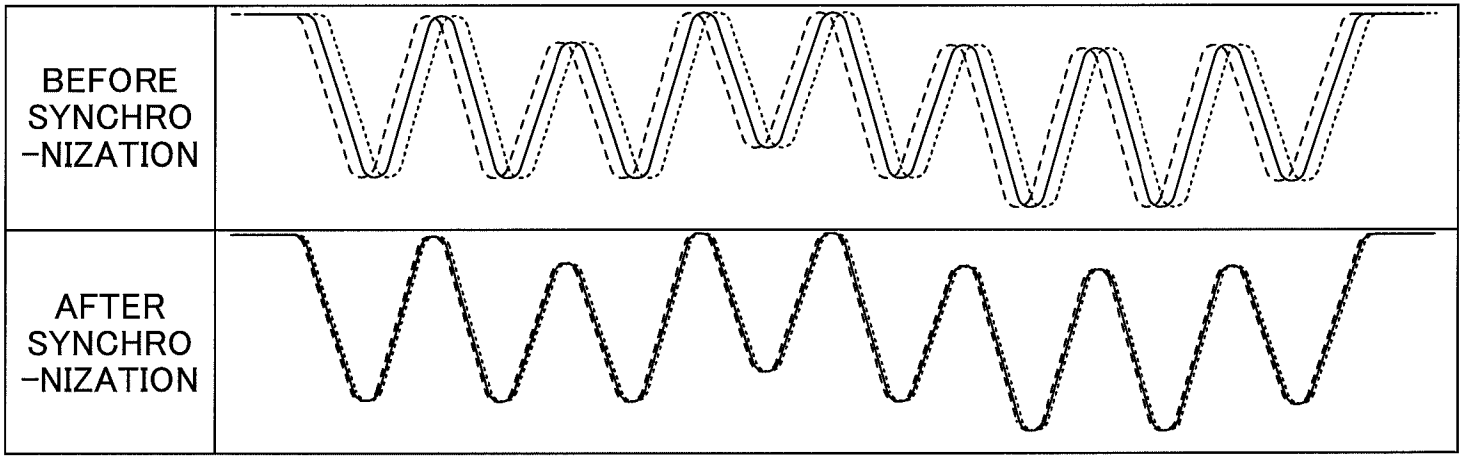
FIG. 22 is an exemplary drawing for explaining a synchronization process.

FIG. 22 is an exemplary diagram which describes a synchronization process of B-(ii). The upper section schematically shows output voltage data before synchronization while the lower section schematically shows output voltage data after synchronization. Unlike before forming the test data, after forming the test data, local minimum values themselves and local maximum values themselves of n-times output voltage data may be matched to align the edge positions. There are a number of methods for matching the local maximum values themselves and the local minimum values themselves (although it is difficult to match them perfectly) of waveform data as in FIGS. 21A and 21B.

As in A-(ii), a relatively simple method is to align a start of n output voltage data sets to a sheet edge of the sheet material 150. If a test pattern is formed at the same position relative to a sheet edge, local maximum values and minimum values of multiple output voltage data may also be aligned at the same position.

Moreover, as in A-(ii), position information in the main scanning direction that is detected by the encoder sensor 42 may be collated with the output voltage data to store the collated result, and position information may be matched to synchronize n detected voltage data sets.

Pre-Processing B-(iii)

The averaging unit calculates an average of n output data sets which are synchronized. As n output voltage data sets exist for each position, the averaging unit calculates an average of the n output voltage data sets for each centroid position.

Signal Correction Process

The synchronization processing unit 613 performs a synchronization process before the signal correction. The synchronization processing unit 613 aligns a sheet edge of the output voltage data after a test pattern print to which the pre-processing of B-(i)-(iii) is applied and the output voltage data before the test pattern print to which the pre-processing of A-(i)-(iii) is applied.

In a manner similar to A-(ii), the alignment is performed by setting an output voltage data set which first exceeded the threshold value as a starting data set. Below, for purposes of explanations, the output voltage data before the test pattern print is called blank sheet measurement data Vsg2 and the output voltage data after the test pattern print is called pattern measurement data Vsg1.

Below, a signal correction process is described.

(2-1) Non-Sheet Reflected Portion Removal Process

A non-sheet reflected portion removal process is a process which reduces, from an output voltage Vsg, a non-sheet reflected portion. More specifically, Vpmin is subtracted from Vsg. This makes it possible to remove an output voltage which is not caused by the sheet material 150.

Figure 23:
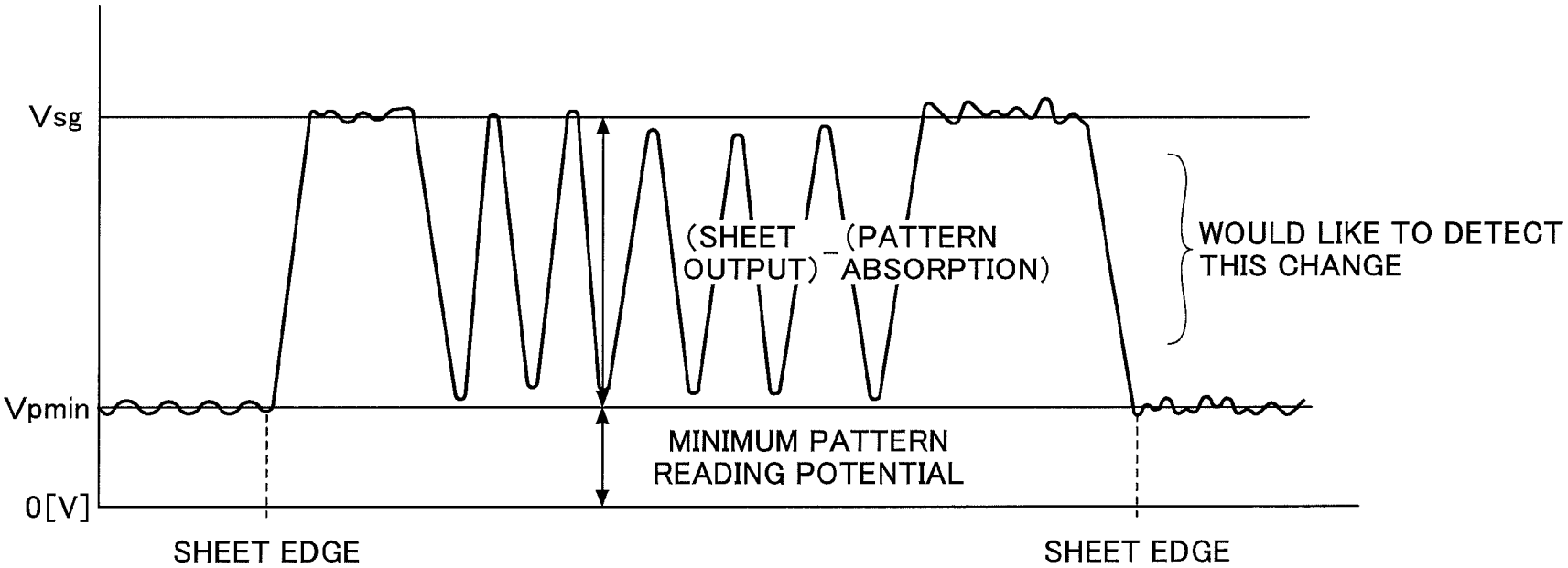
FIG. 23 is an exemplary diagram which explains Vsg and Vpmin.

FIG. 23 is an exemplary diagram which explains Vsg and Vpmin. A constant reflected light which is measured regardless of what is to be measured is called a non-sheet reflected portion. The non-sheet reflected portion includes an aerial scattered light, a reflected light from the platen 40, etc. Therefore, after forming the test pattern, a local minimum value of the output voltage is considered to be due to a non-sheet reflected portion which is not absorbed by ink, so that, in the present embodiment, a minimum voltage Vpmin at the time of pattern reading is set as an output voltage due to the non-sheet reflected portion. Due to a change in drawing density, Vpmin may be set to be the same even when an ink color is different.

Therefore, when Vpmin is subtracted from each of pattern measurement data Vsg1 and blank sheet measurement data Vsg2, an output voltage not due to an ink-reflected portion may be removed. This reduces a variation in the local minimum value of a waveform output when a light receiving element reads the test pattern, making it easier to cause the position of the point of inflection to be concentrated near the center of the threshold area.

Therefore, the pattern-independent portion removal processing unit 614 searches for pattern measurement data sets in sequence to take out all local minimum values. More specifically, when the pattern measurement data set falls below a certain threshold value in a sheet edge, for example, it is successively replaced each time a data set with a smaller value is detected, so that, when a data set with a value exceeding the last data set by at least a predetermined value is obtained, a data set which is stored last is set as Vpmin. This is repeated for each local minimum value shown. It is not necessary to set a local minimum value having a smallest value to Vpmin, so that a local minimum value having a largest value, a median value, or an average of all local minimum values may be set to Vpmin. Vpmin may also be determined when determining each color test pattern 618 for each ink experimentally. Vpmin necessarily takes a value smaller than Vsg1 and Vsg2.

The pattern-independent portion removal processing unit 614 calculates the following:

$$x' = Vsg1 - Vp\min$$

$$y' = Vsg2 - Vp\min$$

Figure 24:
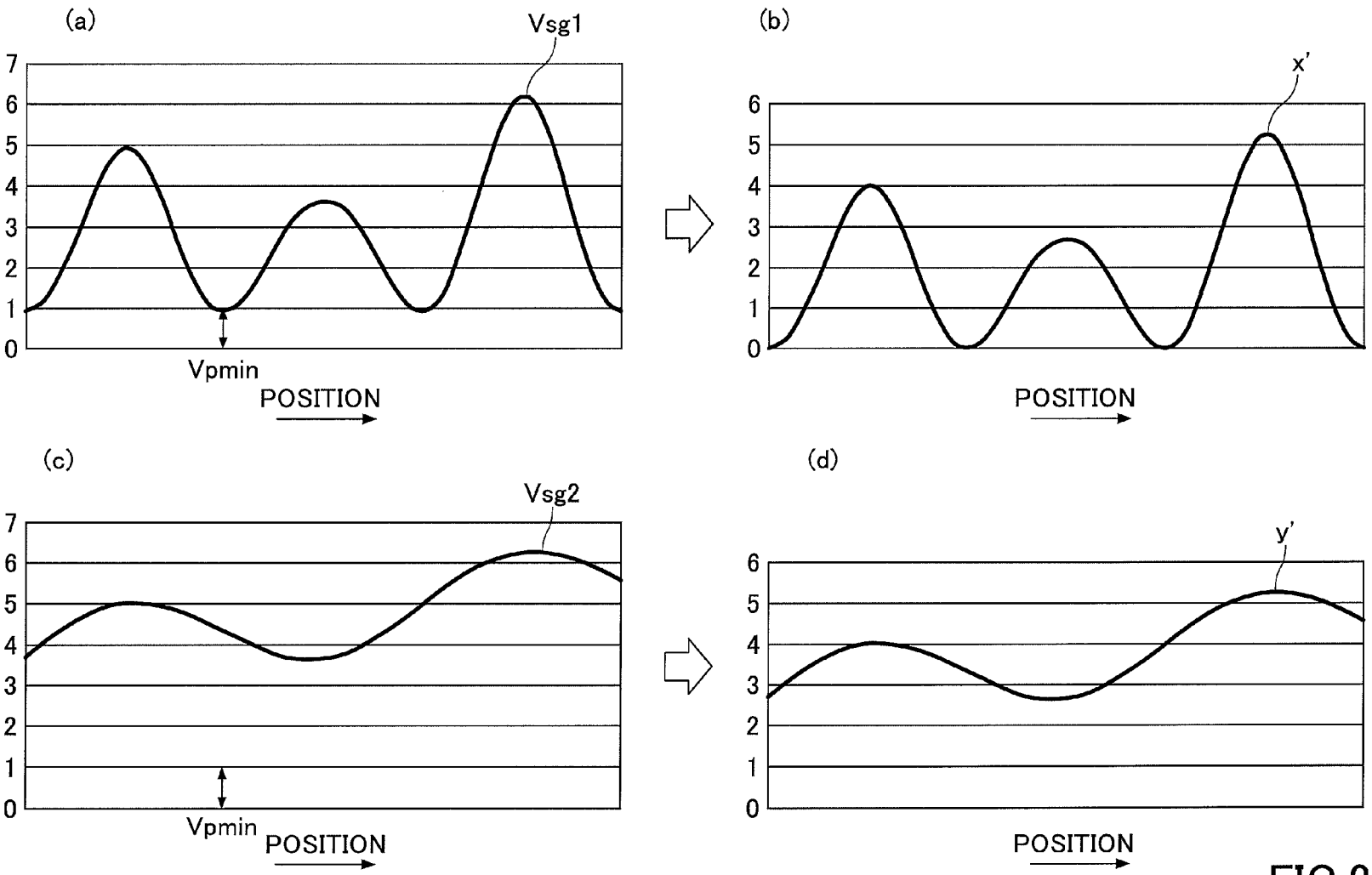
FIG. 24 is a diagram which illustrates one example of an output waveform of pattern measurement data and one example of an output waveform of blank sheet measurement data.

FIG. 24 (in (a)) shows an example of an output waveform of pattern measurement data, while FIG. 24 (in (b)) shows an example of an output waveform, which is pattern measurement data with Vpmin subtracted. As can be seen by comparing (a) and (b) in FIG. 24, it is seen that the non-sheet reflecting portion removal process causes pattern measurement data to take a value which is smaller as a whole by approximately 1 V.

FIG. 24 (in (c)) shows an example of an output waveform of blank sheet measurement data, while FIG. 24 (in (d)) shows an example of an output waveform, which is blank sheet measurement data with Vpmin subtracted. As can be seen by comparing (c) and (d) in FIG. 24, it is seen that the non-sheet reflecting portion removal process causes blank sheet measurement data to take a value which is smaller as a whole by approximately 1 V.

(2-2) Amplitude Correction Process x' and y' become output voltage data for the same scanning position as a result of the synchronization process, so that x' and y' become equal when a spotlight scans a position without the test pattern, while x' becomes generally zero when it scans a position with the test position. This represents that x' is an output voltage due to reflected lights other than lights absorbed by the test pattern with y' as a reference (a maximum) at a certain position. In other words, even when a variation caused by a transmittance of the sheet material differs from position to position, at a position at which the variation increases the output voltage (a position at which y' is large) x' also increases, whereas at a position at which the variation decreases the output voltage (a position at which y' is small) x' also decreases.

In other words, this shows that a variation caused by a position included in x' can be properly corrected with a proportional correction called "x'/y'".

Figure 25:
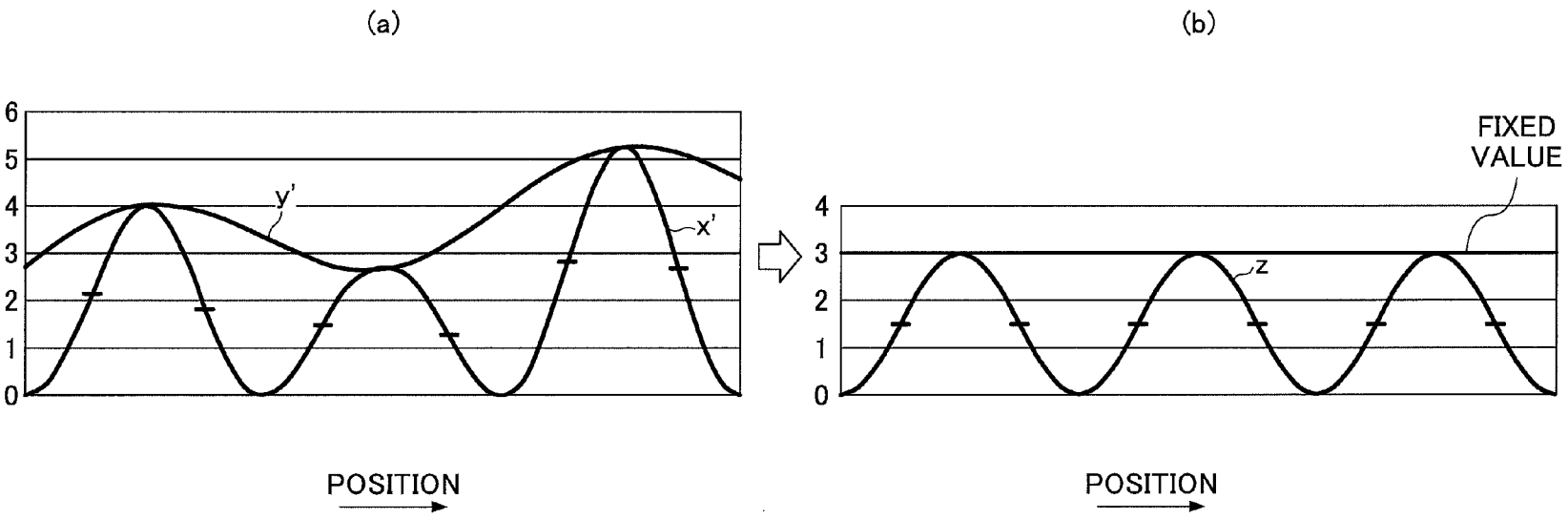
FIG. 25 is an exemplary diagram which schematically explains data z to be operated on that is obtained from Vs1 and Vs2.

FIG. 25 is an exemplary diagram which schematically explains an output voltage z obtained from x' and y'. x' and y' are shown with their being overlapped into one in FIG. 25 (in (a)), while the output voltage z and a fixed value are shown in FIG. 25 (in (b)). Based on the above, when the output voltage is assumed to be z, the output voltage z after the amplitude correction process may be shown as z=fixed value x (x'/y').

The output voltage z is an output voltage such that a variation caused by a position of the sheet material is removed, and constant amplitude that takes a local minimum at a test pattern portion and a local maximum at a plain surface portion is obtained.

Based on the above-described ideas, the amplitude correction processing unit 615 performs an arithmetic operation of "fixed x (x'/y')". With x' and y' already being determined, a fixed value is a value in which Vpmin is subtracted from a maximum value (for example, 4 V) of the output voltage obtained by a sensor calibration. (Vpmin is to be subtracted here since Vpmin is subtracted in both x' and y'.)

As described above, the amplitude correction processing unit 615 may obtain an output voltage z with repeating waveform amplitude as shown in FIG. 25 (in (b)). Thereafter, the ejection timing correction unit 616 may determine the intersecting points C1 and C2 as edge positions as described above from the output voltage z. The non-sheet reflecting portion removal process and the amplitude correction process make it possible to concentrate points of inflection near the center of the threshold area.

The fixed value does not have to be fixed, so that it may be a value in which Vpmin is subtracted from a median value or an average value of Vsg2 which correlates with a local maximum value. Moreover, the waveform amplitude of the output voltage is repeating regardless of the fixed value, which may be changed assuming that the threshold area is adjusted.

(Operation Procedure)

Figure 26:
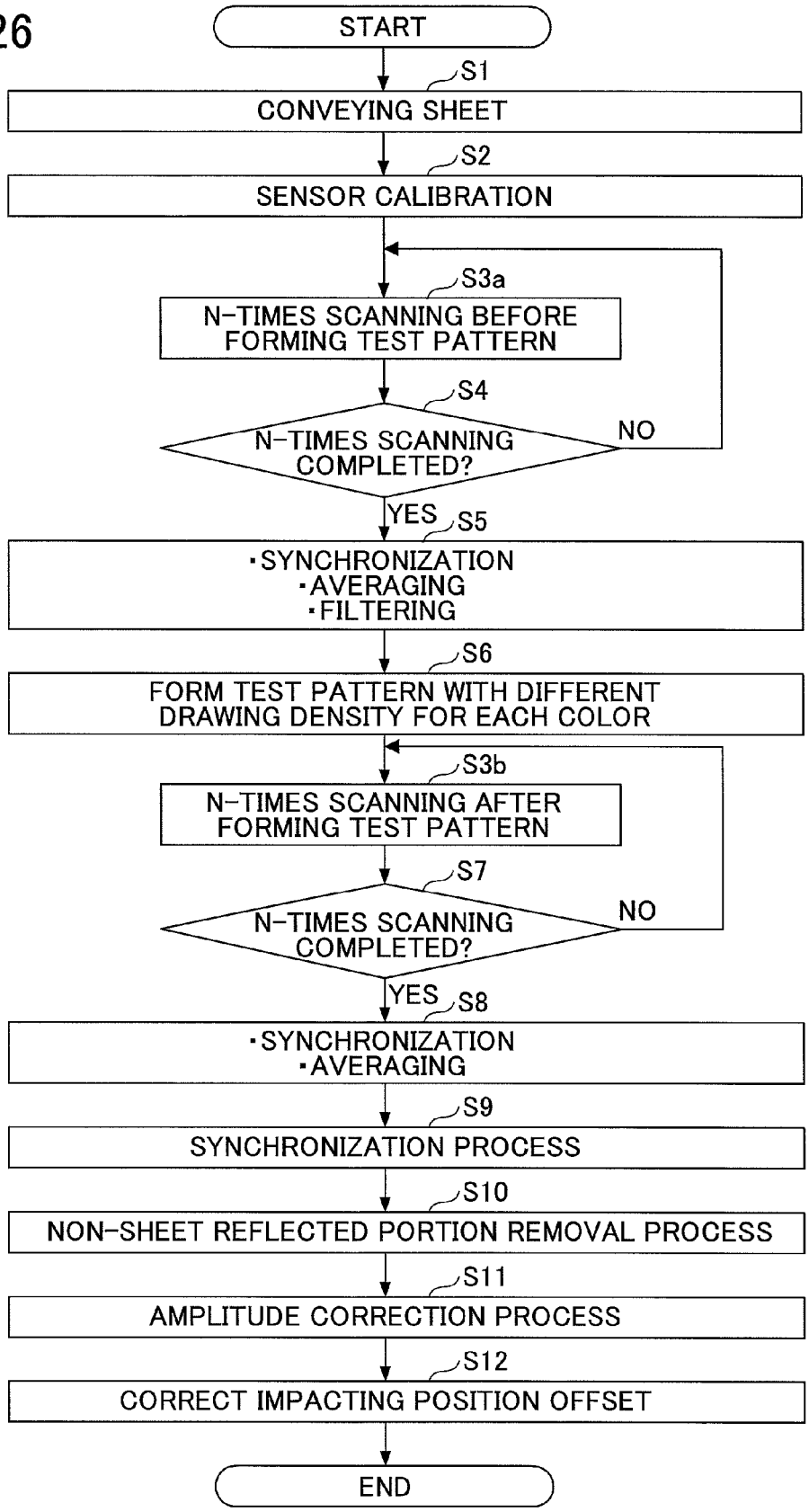
FIG. 26 is a flowchart which illustrates one example of a procedure in which a correction process execution unit performs a signal correction.

FIG. 26 is a flowchart which illustrates one example of a procedure in which a correction process executing unit 526 performs a signal correction.

First, the CPU 301 instructs the main controller 301 to start an impacting position offset correction. With this instruction, the main controller 310 drives the sub-scanning motor 132 via the sub-scanning drive unit 314 and conveys the sheet material 150 to right under the recording head 21 (S1).

Next, the main control unit 310 drives the main scanning motor 8 via the main scanning drive unit 313 to move the carriage 5 over the sheet material 150 and carries out a calibration of a light emitting element and a light receiving element at a specific location on the sheet material 150 (S2). According to the present embodiment, according to calibration information obtained in step S2, it is determined whether the type of paper requires a signal correction process. Details will be described below.

Next, an n-times scanning unit of the pre-print pre-processing unit 611 moves the carriage 5 to a home position and performs n-times scanning before forming the test pattern and stores n output voltage data sets in the shared memory 525 (S3*a*).

Figure 27A:
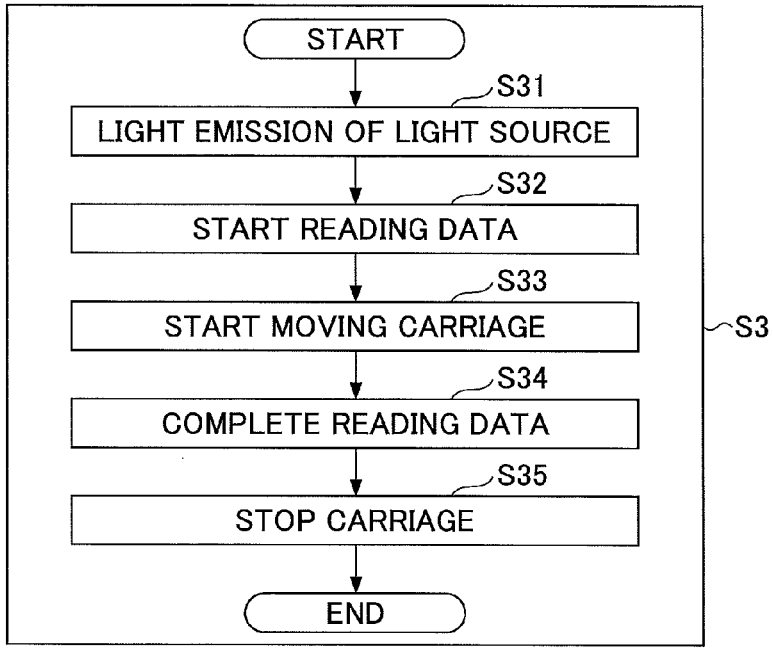
FIGS. 27A, 27B, and 27C are exemplary flowcharts which explain a process of the correction process execution unit.

FIG. 27A is an exemplary flowchart which explains a process in S3. First, the CPU 301 turns on a light emitting element (S31).

Next, the photoelectric conversion circuit 521, etc., starts taking in the output voltage data (S32). When the taking in is started, the main scanning drive unit 313 moves the carriage 5 with the main scanning drive motor 8 (S33). In other words, the photoelectric conversion circuit 521, etc., takes in the output voltage data while the carriage 5 moves. The data is sampled at 20 kHz (a 50 μs interval), for example.

When the carriage 5 arrives at an edge of the image forming apparatus, the photoelectric conversion circuit 521, etc., completes taking in the output voltage data (S34). The main controller 310 accumulates a series of detected voltage data sets in the shared memory 525. The main controller 310 stops the carriage 5 at the home position (S35).

Returning to FIG. 26, the CPU 301 checks, for a predetermined number of times, whether reading of the output voltage data has been completed n times, and, if yes, the process proceeds to the following process S5, and, if no, the process of reading the output voltage data in S3 is performed again (S4).

Figure 27B:
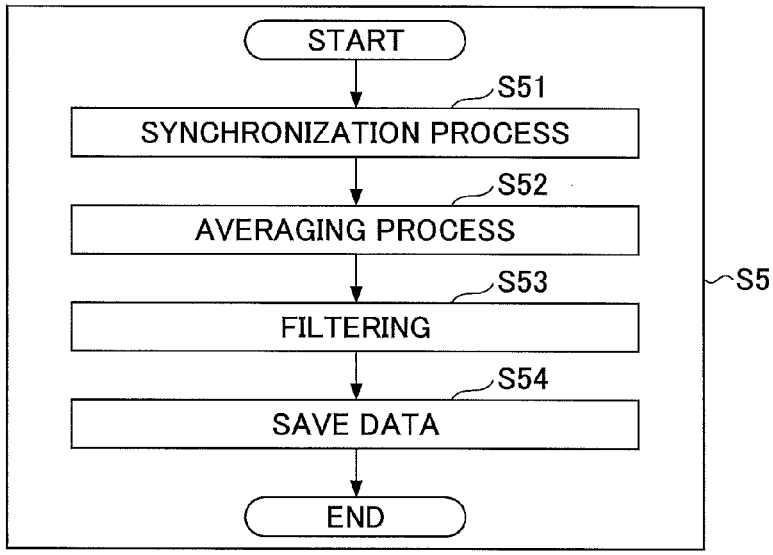

Next, the pre-print pre-processing unit 611 reads the output voltage data before test pattern forming that are accumulated in the shared memory 525 and reads a predetermined number of times to execute the pre-processing and saves the data in the RAM 303 (S5). What is in the pre-processing in S5, which is shown in FIG. 27 (in (b)), has already been explained, so that a repeated explanation is omitted.

Next, in the main controller 310 no sheet conveying is performed with a sub-scanning position of the sheet material 150 as it is, the main scanning controller 313 moves the carriage 5 via the main scanning drive motor 8, and the head drive controller 312 drives the recording heads 21-24 using a test pattern 618 for each color to form a test pattern for adjusting an impacting position offset (S6).

Next, an n-times scanning unit of the post-print pre-processing unit 612 moves the carriage 5 to a home position and performs n-times scanning after forming the test pattern and stores n output voltage data sets in the shared memory 525 (S3*b*).

The CPU 301 checks, for a predetermined number of times, whether reading of the output voltage data has been completed n times, and, if yes, the process proceeds to the following process S8, and, if no, the process of reading the pattern data in S3 is performed again (S7).

Figure 27C:
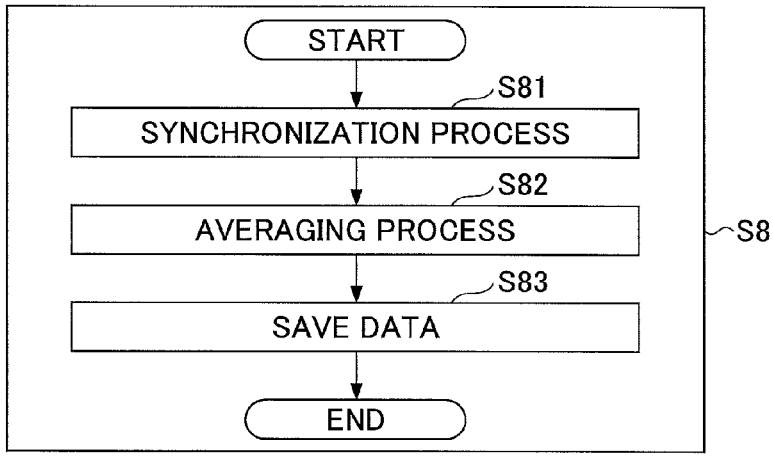

Next, the post-print pre-processing unit 612 reads the output voltage data that are accumulated in the shared memory 525 and reads a predetermined number of times to carry out the pre-processing and saves the data in the RAM 303 (S8). What is in the pre-processing in S5, which is shown in FIG. 27C, has already been explained, so that a repeated explanation is omitted.

Next, the synchronization processing unit 613 reads, from the RAM 303, pattern measurement data and blank sheet measurement data to which the pre-processing is applied to perform position alignment by a synchronization process (S9).

Next, the pattern-independent portion removal processing unit 614 determines Vpmin from a local minimum value of the pattern measurement data and subtracts Vpmin from the blank sheet measurement data and the pattern measurement data, respectively (S10).

Next, using equation "z=fixed value x (x'/y')", the amplitude correction processing unit 615 performs an amplitude correction process and generates an output voltage z (S11). In this way, output voltage data with all inflection points within a threshold area have been obtained.

The ejection timing correction unit 616 detects an edge position (a line center) with the output voltage z, and corrects an impacting position offset of a liquid droplet (S12). In other words, the ejection timing correction unit 616 compares a distance of each line with an optimal distance to calculate an impacting position offset amount, and calculates a correction value of a liquid droplet ejection timing such that an impacting position offset is removed and sets the calculated correction value in the head drive controller 312.

(Determination of Presence/Absence of Signal Correction Process and Sensor Calibration)

Figure 28:
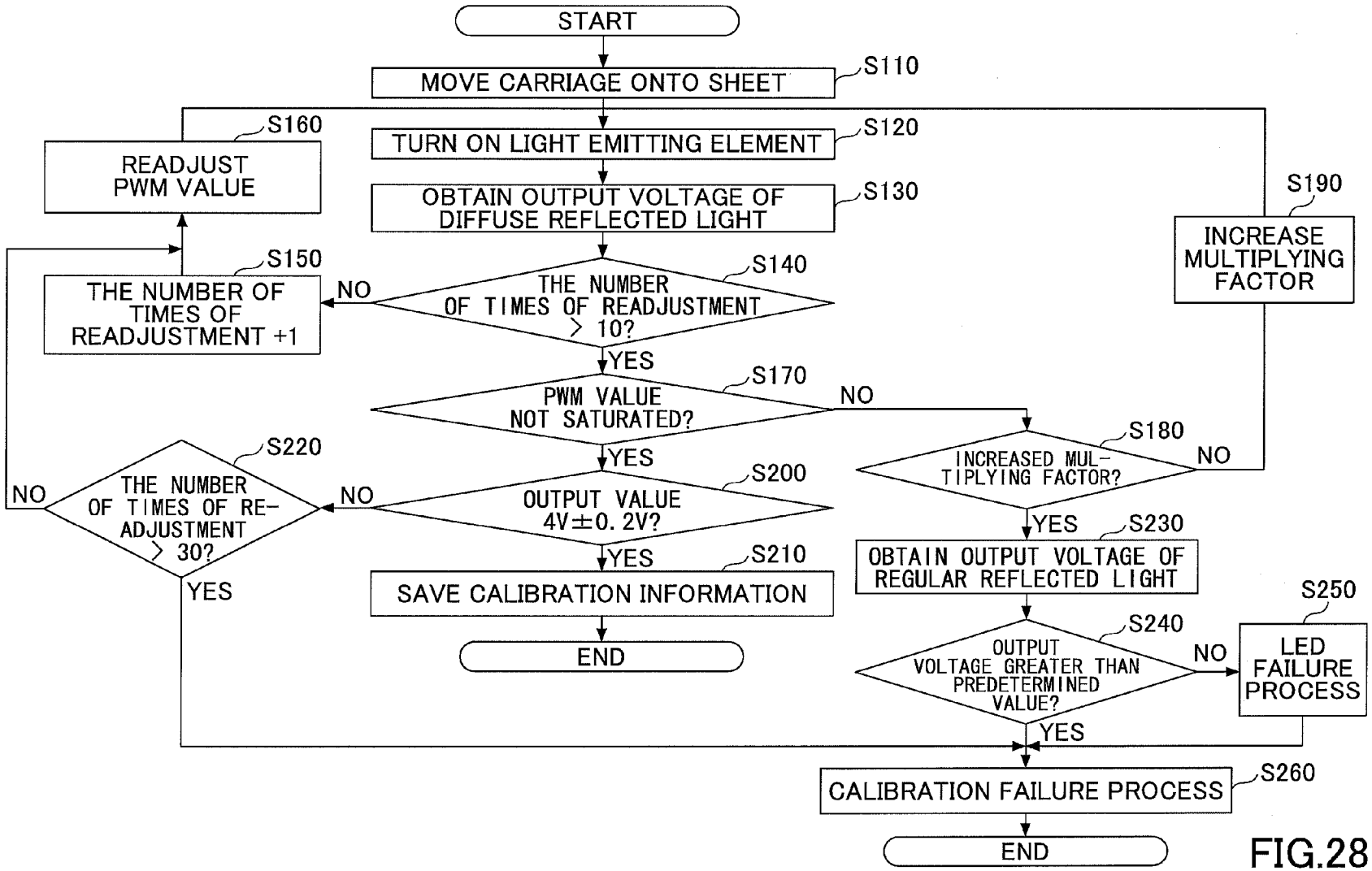
FIG. 28 is one example of a flowchart which shows a procedure of a calibration process.

FIG. 28 is an exemplary flowchart showing a procedure of a calibration process executed in step S2 in FIG. 26. A calibration unit 620 moves the carriage 5 (S110) onto the sheet material to calibrate the light receiving elements 403 and 406 with a print position offset sensor 30 mounted on the carriage 5 at a specific location on a recording medium (S120). The calibration means to adjust a light amount of a sensor light source such as an LED, etc., and determine a PWM value such that a potential (or, in other words, a sensor output value) of a blank sheet surface that is detected by a photo transistor (Ptr) falls within an output voltage range of a target value 4 V±0.2 V. While the PWM value indicates a duty ratio, it may indicate a period or frequency. The light receiving element 403 receives a diffuse reflected light, while the light receiving element 406 receives a regular (specular) reflected light.

Here, the specific location may be one location being a fixed point on paper, or multiple locations which may be obtained by a relative movement of the sheet material and the print position offset sensor 30. In a case of the multiple locations, a light amount is adjusted based on an average value thereof. A predetermined position which is close to the center of the A4 width may be set as the specific location to obtain PWM values corresponding to sheet materials of various shapes.

A target value is adjusted, aiming for an optimal value of the PWM (below called an optimal PWM value) by using a PI control, for example (S130). A calibration unit 620 causes a light emitting element 402 (LED) to emit light at an optimal PWM value determined and a reflected light is received in a light receiving element 403. Here, a received reflected light is assumed to be a diffuse reflected light. When an output voltage of this diffuse reflected light does not converge to a target value of 4 V±0.2 V, a control (a feedback control) is performed, aiming for the optimal value again such as to reduce a difference with a target value.

The calibration unit 620 causes the above-mentioned output voltage to converge to the target value by performing "a loop operation" which repeats the above-mentioned control (S140-S160). In this way, outputs for the respective paper types are adjusted to be 4 V±0.2 V. In other words, the PWM value is adjusted, aiming at the optimal value until the number of times of readjustment exceeds 10 times.

However, there is a case in which convergence does not occur even when this loop operation is repeated. This is a case in which calibration is performed using a tracing paper, a mat film paper, or an OHP sheet that greatly differs in surface properties compared to those of a plain paper, a recycled paper, a glossy paper, etc. For these types of paper, an amount of diffuse reflected light is significantly reduced. The reason is that the transmittance is high for the tracing paper and a mat film paper and that a specular reflectance (regular reflectance) is high (no scattering occurs).

Therefore, even with these types of paper, the process is performed as follows such that an adjustment is made to a target value with a diffuse reflected light. If the loop is repeated 10 times (Yes in S140), the calibration unit 620 determines whether the PWM value is saturated (S170). Saturation means reaching and not exceeding a certain value. The saturation of the PWM value means that the diffuse reflected light amount is significantly reduced.

If it is saturated (No in S170), "a multiplying factor increase operation" which increases a multiplying factor (sensitivity) of an output of the photoelectric conversion circuit 521 is performed to increase a diffuse reflected light output. The calibration unit 620 determines whether the multiplying factor has already been increased (S180) and "the multiplying factor increase operation" is performed (S190) only when the multiplying factor has not been increased (No in S180). Performing "the multiplying factor increase operation" makes it possible to obtain the output of the target value 4 V±0.2 V even with a recording medium having a high transmittance, such as the tracing paper, the mat film paper, etc.

If it is determined in S170 that the PWM value is not saturated (Yes in S170), the calibration unit 620 determines whether an output of the target value 4 V±0.2 V is obtained with the diffuse reflected light (S200).

If the output of the target value 4 V±0.2 V is obtained (Yes in S200), the calibration unit 620 saves the PWM value obtained by the adjustment to complete the process (S210). In step S210, the following calibration information sets are saved in the shared memory 525, for example:

(i) a PWM setting value; (ii) a multiplying factor value; (iii) an output value of a diffuse reflection sensor; and (iv) an output value of a regular reflection sensor.

However, with the recording medium having a high specular reflectance, such as the OHP sheet, there is almost no increase in the diffuse reflection output even with the multiplying factor increase operation. In order to deal with the above, a loop operation aimed for the PWM optimal value is repeated 10 times; and, when, in S190, carrying out the multiplying factor increase operation does not cause the PWM value to be saturated and the output does not become 4 V±0.2 V (No in S200), the calibration unit 620 assumes that what is to be calibrated is a recording medium having a high specular reflectance, carrying out "a switching operation" which switches to receiving a regular reflected light (S230). In other words, the number of times of readjustment is greater than 10 times but does not exceed 30 times, so that it is determined to be No in step 220, so that switching to receiving the regular reflected light in S230 is carried out via S120, S130, S140, S170, and S180.

While it is assumed to be a sheet material having a high specular reflectance, when the output value of the light receiving element 406 (the regular reflected light) is less than or equal to a predetermined value (No in S240), it is assumed that there is a failure in an LED (the light emitting element 402), performing a failure process (S250). While an automatic position offset adjustment is not possible, a user can manually adjust the position offset when a manual position offset adjustment mode is also installed, recording only a log.

When the output value of the light receiving element 406 (the regular reflected light) is greater than the predetermined value (Yes in S240), a correction determining unit 621 determines that liquid droplet position offset adjustment is not performed, establishing that the sheet material 150 is partially film or an OHP film having a high specular reflectance. Thus, the process is completed, determining that it is a calibration failure (S260). Even for a sheet with large specular reflection, a position offset adjustment is possible. While not dealt with in FIG. 28, a recording value may be saved when an output greater or equal to a predetermined value is provided even for the sheet with the large specular reflection.

Moreover, in FIG. 28, while adjustment with the diffuse reflected light is performed first, and switching to a regular reflected light is performed when the adjustment cannot be fully completed, this switching sequence may be reversed, so it may be arranged such that adjustment with the regular reflected light is performed first, then switching to the diffuse reflected light. The sensor calibration operation may be performed as described above.

The correction determining unit 621 determines presence/absence of a signal correction process and presence/absence of a correction of an ejection timing using a fact that a calibration flow differs from one paper type to another.

FIG. 29 is one example of a diagram showing a relationship of processing results of calibration; the paper type; and the presence/absence of the signal correction process. A sheet material for which a correction of the ejection timing is to be performed is classified into any of the following three:

(i) A sheet material not requiring the signal correction process, such as the plain paper, the recycled paper, the glossy paper;

(ii) A sheet material requiring the signal correction process, such as the tracing paper, the mat film paper, etc.

(iii) A sheet material for which correction of the ejection timing itself is not required, such as the OHP film.

As described in FIG. 28, these are cases in which the calibration information is saved and in which the diffuse reflected light causes the target value to converge to 4 V±0.2 V. The correction determining unit 621 determines that the signal correction process is not required if the multiplying factor increase process is not performed in this state. Therefore, a correction process of the ejection timing is performed without a signal correction process (for (i)). In this case, it may be determined that the sheet material is any of the plain paper, the recycled paper, and the glossy paper. The ejection timing correcting unit 616 corrects for the liquid droplet ejection timing based on an impacting position offset amount determined from a line center, reading output voltage data.

Moreover, while the diffuse reflected light causes the target value to converge to 4 V±0.2 V, the correction determining unit 621 determines that the signal correction process is required if the multiplying factor increase operation is performed. Therefore, a correction process of the ejection timing is performed with the signal correction process (for (ii)). In this case, the sheet material may be determined to be the tracing paper or the mat film paper. The ejection timing correction unit 616 corrects for the liquid droplet ejection timing from the line center determined with the output voltage data for each signal correction process.

Moreover, if the PWM is saturated with the diffuse reflected light, switching to the regular reflected light, the correction determining unit 621 determines that a correction process of the ejection timing is not performed (for (iii)). In this case, the sheet material is determined to be partially film or the OHP sheet.

When causing a convergence with the regular reflected light, an ejection timing correction process may be performed. In this case, using a regular reflected light, only a correction process of the ejecting timing is performed, not performing a signal correction process. Not only the kinds of sheets may be determined, but various determinations may be made.

As described above, the image forming apparatus according to the present embodiment can set the presence/absence of a signal correction process using a calibration function of a sensor (a light receiving element). The paper type of the sheet material may be correctly set in an ensured manner to obtain desired adjustment accuracy with the signal correction process for the tracing paper, etc., and also to correct for the ejection timing without increasing down time since the signal correction process is not performed for the plain paper, etc. Moreover, the correction process of the ejection timing is not performed for the OHP, etc., also making it possible to prevent performing an ejection timing correction process with low adjustment accuracy on the sheet material which cannot be calibrated to the target value.

Moreover, at the time of correction of the ejection timing, a pattern print or pattern sensing operation is performed, so that recording heads 21-24 are not protected by the maintenance mechanism 26. Thus, while the head is likely to become dry in the correction process of the ejection timing, the frequency of the correction process of the ejection timing is reduced to also obtain an advantageous effect of protecting the recording heads 21-24 from drying.

Embodiment 2

In the present embodiment, a signal correction process is described for an image forming system embodied by a server, not an image forming apparatus.

Figure 30:
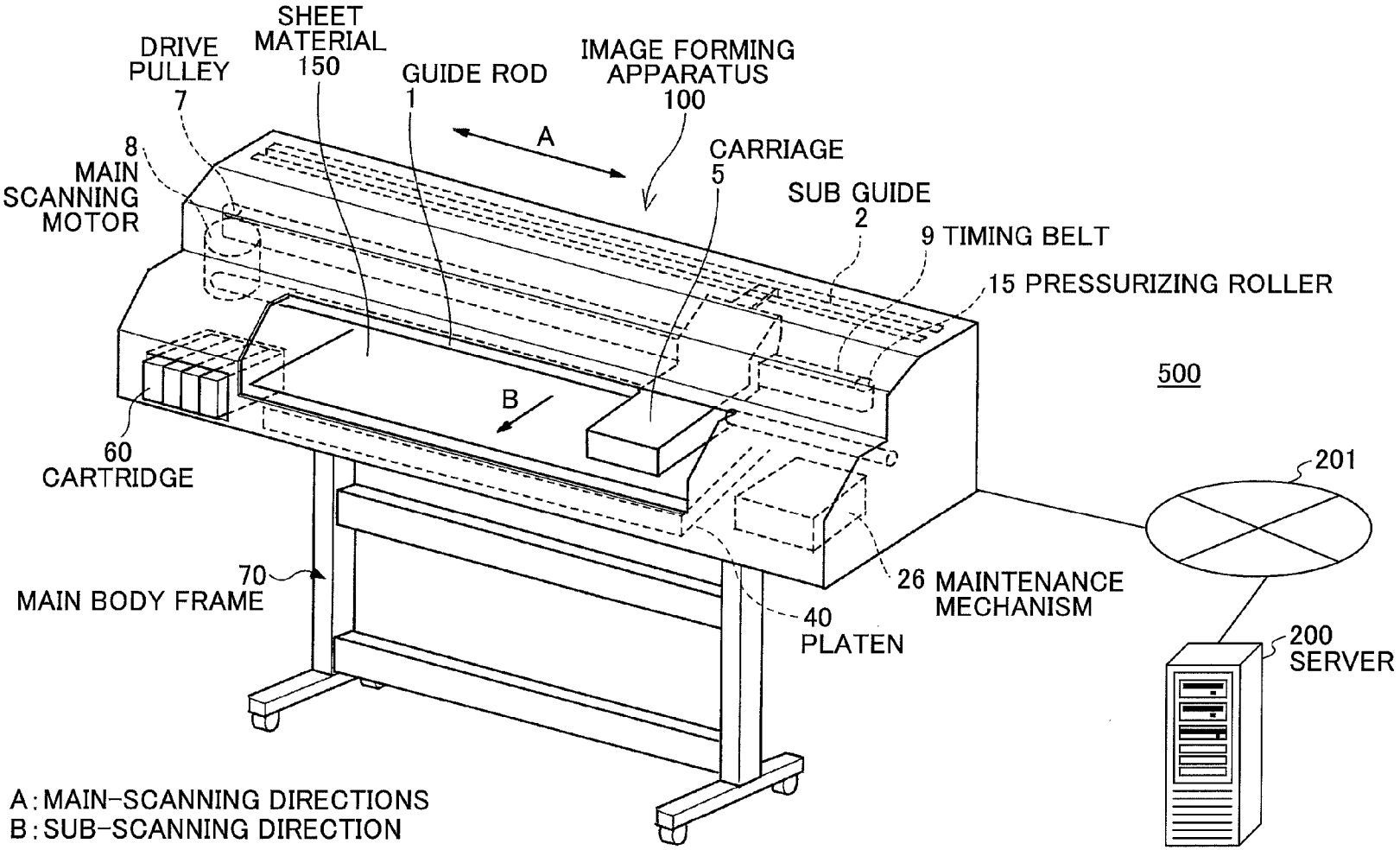
FIG. 30 is an exemplary diagram which schematically explains an image forming system which has an image forming apparatus and a server.

FIG. 30 is an exemplary diagram which schematically describes an image forming system 500 which has an image forming apparatus 100 and a server 200. In FIG. 30, the same letters are given to the same elements as FIG. 4, so that a repeated explanation is omitted. The image forming apparatus and the server 200 are connected via a network 201. The network 201 is an in-house LAN; a WAN which connects the LANs; or the Internet, or a combination thereof.

In the image forming system 500 as in FIG. 30, the image forming apparatus 100 forms a test pattern and scans the test pattern by a print position offset sensor, and the server 200 calculates the correction value of the liquid droplet ejection timing. Therefore, a processing burden of the image forming apparatus 100 may be reduced and functions of calculating a correction value of a liquid droplet ejection timing may be concentrated to the server 200.

Figure 31:
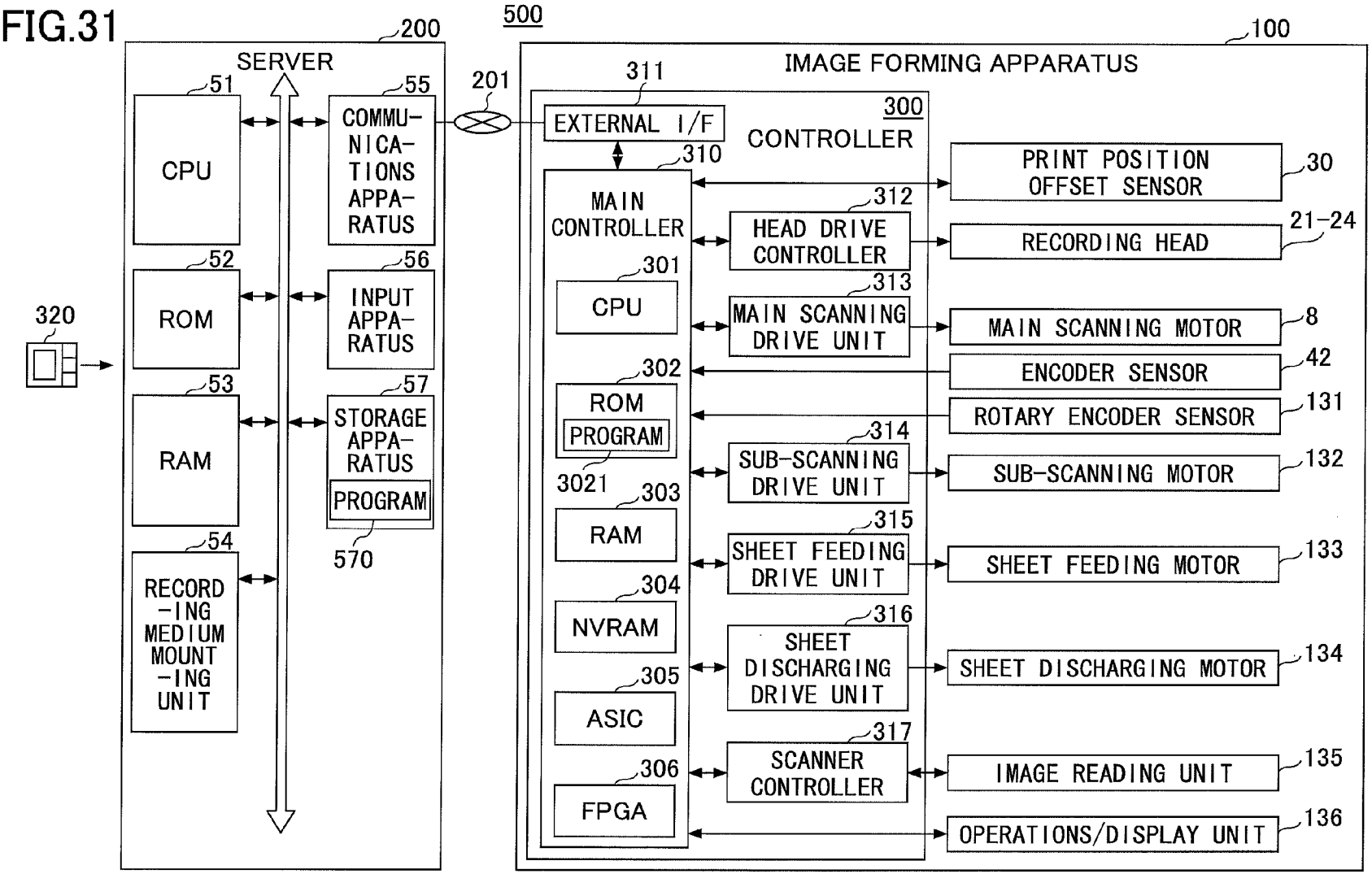
FIG. 31 is a diagram illustrating an example of a hardware configuration of the server and the image forming apparatus.

FIG. 31 is a diagram illustrating an example of a hardware configuration of the server 200 and the image forming apparatus 100. The server 200 includes a CPU 51, a ROM 52, a RAM 53, a recording medium mounting unit 54, a communications apparatus 55, an input apparatus 56, and a storage apparatus 57 that are mutually connected via a bus. The CPU 51 reads an OS (Operating System) and a program 570 from the storage apparatus 57 to execute the program with the RAM 53 as a working memory. The program 570 performs the same process as in the Embodiment 1.

The RAM 53 becomes a working memory (a main storage memory) which temporarily stores necessary data, while a BIOS with initialized data, a bootstrap loader, etc., are stored in the ROM 52. The storage medium mounting unit 54 is an interface in which is mounted a portable storage medium 320.

The communications apparatus 55, which is called a LAN card or an Ethernet card, connects to the network 201 to communicate with an external I/F 311 of the image forming apparatus 100. At least an IP address or a domain name of the server 200 is registered in the image forming apparatus 100.

The input apparatus 56 is a user interface which accepts various operating instructions of the user, such as a keyboard, mouse, etc. It may also be arranged for a touch panel or a voice input apparatus to be the input apparatus.

The storage apparatus 57 is embodied as a non-volatile memory such as a HDD (Hard Disk Drive), a flash memory, etc., storing an OS, a program, etc. The program 570 is distributed in a form recorded in a storage medium 320, or in a manner such that it is downloaded from the server 200 (not shown).

Figure 32:
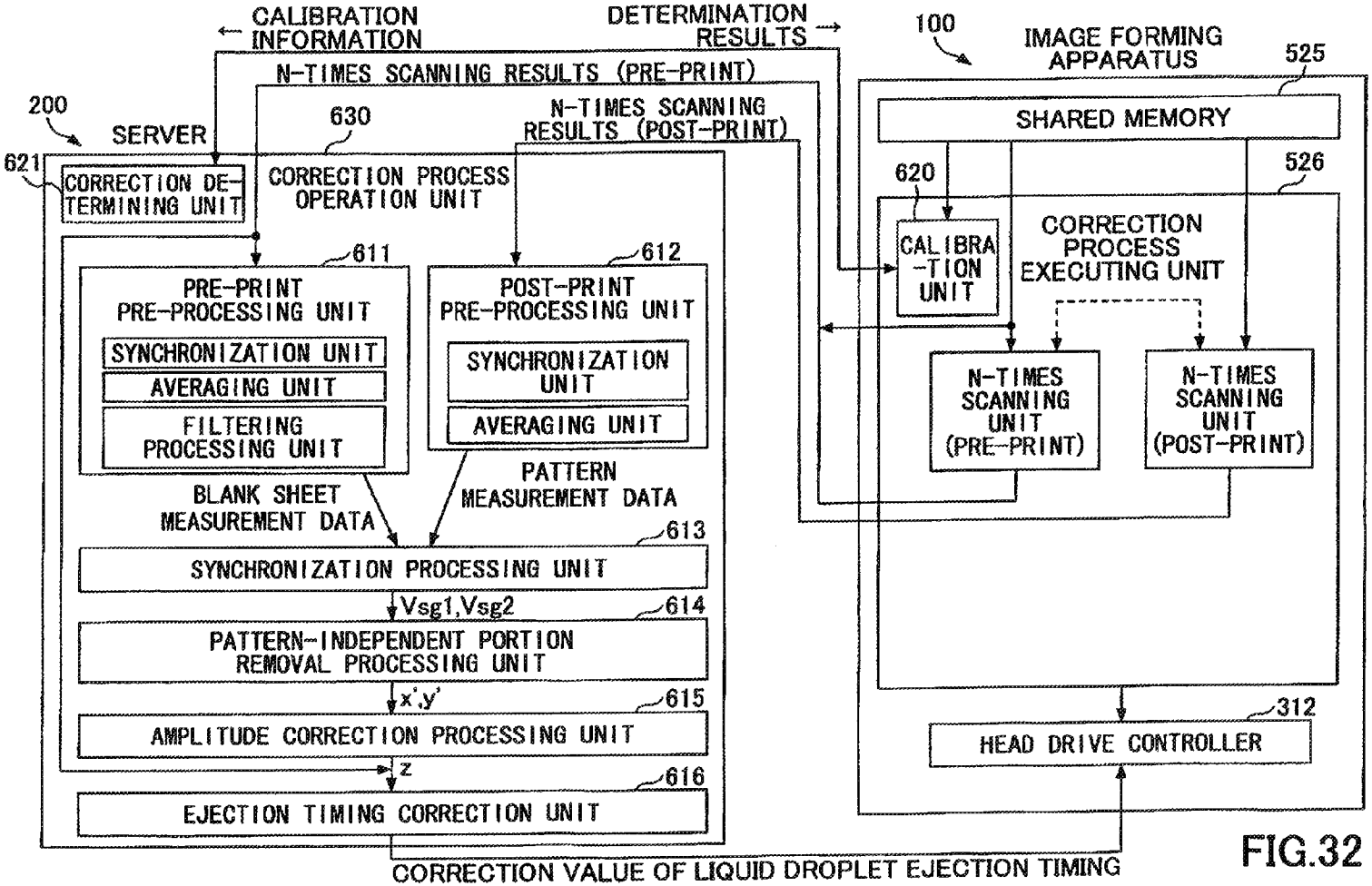
FIG. 32 is an exemplary functional block diagram of the image forming system.

FIG. 32 is an exemplary functional block diagram of the image forming system 500. The correction process executing unit 526 of the image forming apparatus 100 retains the calibration unit 620 and pre-print and post-print n-time scanning unit, while the server side includes the other functions. A function at the server side is called a correction process operating unit 630. The calibration unit 620 performs a calibration of the light receiving elements 403 and 406 in the same manner as in Embodiment 1 and creates calibration information. The image forming apparatus 100 transmits the calibration information to the server 200.

The correction process operating unit 630 includes a correction determination unit 621, a pre-print synchronization unit, an averaging unit, a filtering unit, a post-print synchronization unit, an averaging unit, a synchronization process unit 613, a pattern-independent portion removal process unit 614, an amplitude correction process unit 615, and an ejection timing correction unit 616. A function of each block is the same as Embodiment 1, so that a repeated explanation is omitted.

In the image forming system 500, first the correction determination unit 621 determines, based on calibration information, whether a correction process for the liquid droplet ejection timing is performed and whether a signal correction process is performed and transmits the determined results to the image forming apparatus. When the correction process of the liquid droplet ejection timing is not performed, the image forming apparatus completes the process.

When the signal correction process is not performed, the image forming apparatus transmits output detection data to the server and the ejection timing correction unit 616 of the server calculates a correction value of the ejection timing. The image forming apparatus may include at least one of the correction determination unit 621 and the ejection timing correction unit 616.

When performing the signal correction process, the n-time scanning unit on the image forming apparatus side transmits, to the server 200, n pre-print and post-print data sets. The correction process operating unit 630 on the server side performs an amplitude correction process to calculate a correction value of a liquid droplet ejection timing. The server 200 transmits the correction value at the liquid droplet ejection timing to the image forming apparatus 100, so that the head drive controller 312 may change the ejection timing.

Figure 33:
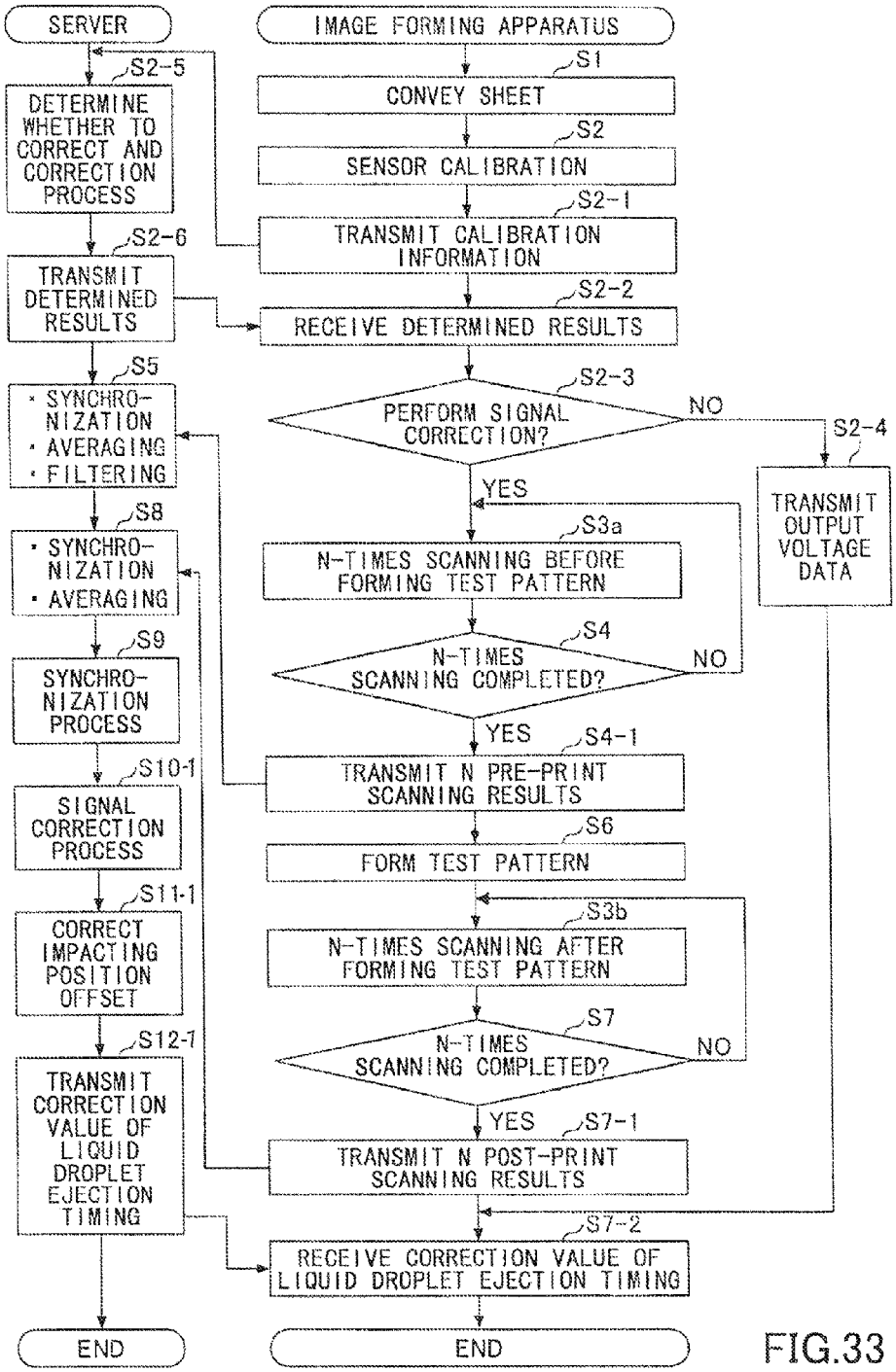
FIG. 33 is one example of a flowchart which shows an operational procedure of the image forming system.

FIG. 33 is one example of a flowchart which shows an operational procedure of the image forming system 500. As shown, S5 and S8, S9, S10-1, S11-1 and S12-1 in FIG. 33 are performed by the server 200, while a process required for the other pre-print and post-print n-times scanning is performed by the image forming apparatus 100.

The process in S1 and S2 is the same as Embodiment 1. The image forming apparatus transmits the calibration information to the server (S2-1). The server determines whether a liquid droplet ejection timing is corrected by the calibration information and, if yes, whether a signal correction process is performed (S2-5). The server transmits the determined results to the image forming apparatus (S2-6).

The image forming apparatus receives the determined results (S2-2) to determine whether the signal correction process is performed (S2-3). If the signal correction process is not performed, the image forming apparatus transmits output voltage data to the server (S2-4), so that the process moves to S7-2.

If the signal correction process is performed, the process of S4 and beyond is executed. The image forming apparatus 100 newly performs a process which transmits n pre-print scanning results in step S4-1 and a process which transmits n post-print scanning results in step S7-1. Moreover, the image forming apparatus 100 newly performs a process which receives a correction value of the liquid droplet ejection timing in step S7-2.

On the other hand, the server 200 performs the signal correction process in S10-1 and, after S11-1 a process of transmitting a correction value of the liquid droplet ejection timing to the image forming apparatus 100 is newly performed in S12-1.

In this way, with only a change in where the process is performed, the image forming system 500 may suppress an impact received from a characteristic of a sheet material as in Embodiment 1, to accurately correct the liquid droplet ejection timing.

The present application is based on and claims priority of Japanese Priority Application No. 2012-266314 filed on Dec. 5, 2012, the entire contents of which are hereby incorporated by reference.

The invention claimed is:

1. An image forming apparatus configured to read a test pattern formed by ejecting liquid droplets onto a recording medium to adjust an ejection timing of the liquid droplets, comprising:

a light emitting unit configured to irradiate a light onto the recording medium;

a first light receiving configured to receive diffuse reflected light and a second light receiving unit configured to receive regular reflected light from the recording medium;

a processor configured to, receive detection data corresponding to at least one of the regular reflected light and the diffuse reflected light, adjust a sensitivity of at least one of the first and second light receiving units based on the received detection data such that an output of the at least one of the first and second light receiving units falls within a range before the test pattern is formed, relatively move at least one of the recording medium and a sensor unit;

select one of a first correction method and a second correction method to adjust the ejection timing of the liquid droplets based on the adjusted sensitivity of the at least one of the first and second light receiving units, wherein the first correction method includes detecting a position of the test pattern from a scanning position of the light by the at least one of the first and second light receiving units while the sensor unit moves relative to the recording medium after the test pattern is formed, the second correction method includes detecting the position of the test pattern after an amplitude of an interval period of the test pattern is aligned to be generally constant, the amplitude appearing in the detection data of the reflected light received from the scanning position of the light by the at least one of the first and second light receiving units while the sensor unit moves relative to the recording medium after the test pattern is formed, the processor is configured to receive the detection data corresponding to the regular reflected light when the detection data corresponding to the diffuse reflected light is less than a first threshold value, and when the detection data corresponding to the regular reflected light received by the second light receiving unit is larger than a second threshold value and is to be used in the adjusting of the at least one of the first and second light receiving units, the processor selects neither the first correction method nor the second correction method and does not adjust the ejection timing of the liquid droplets.

2. The image forming apparatus as claimed in claim 1, wherein the adjusted sensitivity includes light reflection intensity information of the recording medium, and the processor is configured to, select the first correction method if the reflection intensity information indicates that a reflection intensity of the recording medium is greater than or equal to a value, and select the second correction method if the reflection intensity information indicates that the reflection intensity of the recording medium is less than the value.

3. The imaging forming apparatus as claimed in claim 1, wherein the adjusted sensitivity includes sensitivity multiplying factor information of the first and second light receiving units, and the processor is configured to select the first correction method or the second correction method in accordance with the sensitivity multiplying factor information.

4. The image forming apparatus as claimed in claim 1, wherein, when the detection data corresponding to the regular reflected light received by the second light receiving unit is less than or equal to the first threshold value, the processor is configured to determine that there is a failure in the light emitting unit.

5. The imaging forming apparatus as claimed in claim 1, wherein the adjusted sensitivity includes sensitivity multiplying factor information of the first and second light receiving units, the processor is configured to estimate a type of the recording medium in accordance with the sensitivity multiplying factor information, and the type of the recording medium is estimated in accordance with whether the detection data corresponding to the regular reflected light received by the second light receiving unit is greater than the first threshold value.

6. The image forming apparatus as claimed in claim 1, wherein the second correction method includes, obtaining first detection data corresponding to the reflected light received from the scanning position of the light by the at least one of the first and second light receiving units while the sensor unit moves relative to the recording medium before the test pattern is formed;

obtaining second detection data corresponding to the reflected light received by the at least one of the first and second light receiving units while the light moves over the test pattern of generally the same scanning position as the scanning position while the sensor unit moves relative to the recording medium after the test pattern is formed;

subtracting a value comparable to a local minimum value of the second detection data from each of the first detection data and the second detection data; and determining a proportion of the second detection data relative to the subtracted first detection data to align a local maximum value of the first detection data to be generally constant.

7. A non-transitory computer readable medium including computer program product, the computer program product comprising instructions for causing an image forming apparatus including a sensor unit having a light emitting unit configured to irradiate light onto a recording medium, a first light receiving unit configured to receive diffuse reflected light, and a second light receiving unit configured to receive regular reflected light from the recording medium that reads a test pattern formed by ejecting liquid droplets onto the recording medium to adjust an ejection timing of the liquid droplets, the instructions, when executed by a processor, causing the processor to perform functions including:

receiving detection data corresponding to at least one of the regular reflected light and the diffuse reflected light;

adjusting a sensitivity of at least one of the first and second light receiving units based on the received detection data such that an output of the at least one of the first and second light receiving units falls within a range before the test pattern is formed, relatively moving at least one of the recording medium and the sensor unit; and selecting one of a first correction method and a second correction method to adjust the ejection timing of the liquid droplets based on the adjusted sensitivity of the at least one of the first and second light receiving units, wherein the first correction method includes detecting a position of the test pattern from a scanning position of the light by the at least one of the first and second light receiving units while the sensor unit moves relative to the recording medium after the test pattern is formed, and the second correction method includes detecting the position of the test pattern after aligning an amplitude of an interval period of the test pattern to be generally constant, the amplitude appearing in the detection data of the reflected light received from the scanning position of the light by the at least one of the first and second light receiving units while the sensor unit moves relative to the recording medium after the test pattern is formed, the receiving receives the detection data corresponding to the regular reflected light when the detection data corresponding to the diffuse reflected light is less than a first threshold value, and when the detection data corresponding to the regular reflected light received by the second light receiving unit is larger than a second threshold value and is to be used in the adjusting of the at least one of the first and second light receiving units, the selecting selects neither the first correction method nor the second correction method and the adjusting does not adjust the ejection timing of the liquid droplets.

8. An image forming system configured to read a test pattern formed by ejecting liquid droplets onto a recording medium to adjust an ejection timing of the liquid droplets, comprising:

a light emitting unit configured to irradiate a light onto the recording medium;

a first light receiving unit configured to receive diffuse reflected light and a second light receiving unit configured to receive regular reflected light from the recording medium;

a processor configured to, receive detection data corresponding to at least one of the regular reflected light or the diffuse reflected light, adjust a sensitivity of at least one of the first and second light receiving units based on the received detection data such that an output of the at least one of the first and second light receiving units falls within a range before the test pattern is formed, relatively move at least one of the recording medium and a sensor unit;

select one of a first correction method and a second correction method to adjust the ejection timing of the liquid droplets based on the adjusted sensitivity of the at least one of the first and second light receiving units, wherein the first correction method includes detecting a position of the test pattern from a scanning position of the light by the at least one of the first and second light receiving units while the sensor unit moves relative to the recording medium after the test pattern is formed, and the second correction method includes detecting the position of the test pattern after an amplitude of an interval period of the test pattern is aligned to be generally constant, the amplitude appearing in the detection data of the reflected light received from the scanning position of the light by the at least one of the first and second light receiving units while the sensor unit moves relative to the recording medium after the test pattern is formed, the processor is configured to receive the detection data corresponding to the regular reflected light when the detection data corresponding to the diffuse reflected light is less than a first threshold value, and when the detection data corresponding to the regular reflected light received by the second light receiving unit is larger than a second threshold value and is to be used in the adjusting of the at least one of the first and second light receiving units, the processor selects neither the first correction method nor the second correction method and does not adjust the ejection timing of the liquid droplets.

* * * * *